US008766179B2

(12) United States Patent
Kaltashov et al.

(10) Patent No.: US 8,766,179 B2
(45) Date of Patent: Jul. 1, 2014

(54) TEMPERATURE-CONTROLLED ELECTROSPRAY IONIZATION SOURCE AND METHODS OF USE THEREOF

(71) Applicant: The University of Massachusetts, Boston, MA (US)

(72) Inventors: Igor A. Kaltashov, Leverett, MA (US); Guanbo Wang, Amherst, MA (US); Rinat R. Abzalimov, Amherst, MA (US)

(73) Assignee: The University of Massachusetts, Boston, MA (US)

( * ) Notice: Subject to any disclaimer, the term of this patent is extended or adjusted under 35 U.S.C. 154(b) by 0 days.

(21) Appl. No.: 13/735,348

(22) Filed: Jan. 7, 2013

(65) Prior Publication Data

US 2013/0234017 A1 Sep. 12, 2013

Related U.S. Application Data

(60) Provisional application No. 61/608,834, filed on Mar. 9, 2012.

(51) Int. Cl.
*H01J 49/00* (2006.01)

(52) U.S. Cl.
USPC ..... 250/288; 250/281; 250/282; 250/283; 250/287; 250/289; 250/290

(58) Field of Classification Search
USPC ..... 250/281–283, 287–290
See application file for complete search history.

(56) References Cited

U.S. PATENT DOCUMENTS 4,861,988 A * 8/1989 Henion et al. ..... 250/288
5,504,327 A * 4/1996 Sproch et al. ..... 250/288
8,039,795 B2 * 10/2011 Mordehai et al. ..... 250/288

OTHER PUBLICATIONS

Benesch et al.; "Thermal Dissociation of Multimeric Protein Complexes by Using Nanoelectrospray Mass Spectrometry"; Anal. Chem.; 75; pp. 2208-2214; (2003).
Daneshfar et al.; J. Am. Chem. Soc.; 126; pp. 4786-4787; (2004).
Geels et al.; "Thermal Activation of the Co-Chaperonins GroES and gp31 Probed by Mass Spectrometry"; Rapid Communications in Mass Spectrometry; 22; pp. 3633-3641; (2008).
He et al.; "High Throughput Thermostability Screening of Monoclonal antibody Formulations"; Journal of Pharmaceutical Sciences; 99(4); pp. 1707-1720; (2010).
Ionescue et al.; "Contribution of Variable Domains to the Stability of Humanized IgG1 Monoclonal Antibodies"; Journal of Pharmaceutical Sciences; 97(4); pp. 1414-1426; (2008).
Konermann et al.; "Electrochemically Induced pH Changes Resulting in Protein Unfolding in the Ion Source of an Electrospray Mass Spectrometer"; Anal. Chem.; 73; pp. 4836-4844; (2001).
Shi et al.; "Thermal Unfolding of Proteins Probed by Laser Spray Mass Spectrometry"; Rapid Communications in Mass Spectrometry; 22; pp. 1430-1436; (2008).

(Continued)

*Primary Examiner* — Jack Berman
*Assistant Examiner* — Meenakshi Sahu
(74) *Attorney, Agent, or Firm* — Cantor Colburn LLP

(57) ABSTRACT

Disclosed herein is an electrospray ionization source that provides improved temperature control compared to prior sources. A combination of a continuous flow sample design and the use of a long heat shield combine to improve thermal control and reduce memory effects observed with prior designs. The temperature-controlled source is particularly useful for the study of biomolecules, particularly the study of protein aggregation.

22 Claims, 19 Drawing Sheets

(56) References Cited

OTHER PUBLICATIONS

Tischenko et al.; "A Thermodynamic Study of Cooperative Structures in Rabbit Immunoglobulin G"; Eur. J. Biochem.; pp. 517-521; (1982).

Van Berkel et al.; "Changes in Bulk Solution pH Caused by the Inherent Controlled-Current Electrolytic Process of an Electrospray Ion Source"; International Journal of Mass Spectrometry and Ion Processes; 162; pp. 55-67; (1997).

Vermeer et al.; "The Thermal Stability of Immunoglobulin: Unfolding and Aggregation of a Multi-Domain Protein"; Biophysical Journal; 78; pp. 394-404; (2000).

Wang, et al.; "Direct Monitoring of Heat-Stressed Biopolymers with Temperature-Controlled Electrospray Ionization Mass Spectrometry"; Anal. Chem; 83; pp. 2870-2876; (2011).

* cited by examiner

TEMPERATURE-CONTROLLED ELECTROSPRAY IONIZATION SOURCE AND METHODS OF USE THEREOF

STATEMENT REGARDING FEDERALLY SPONSORED RESEARCH & DEVELOPMENT

This invention was made with government support under CHE-0750389 awarded by the National Science Foundation. The government has certain rights in the invention.

CROSS-REFERENCE TO RELATED APPLICATIONS

This application claims priority to U.S. Provisional Application 61/608,834 filed on Mar. 9, 2012, which is incorporated herein by reference in its entirety.

FIELD OF THE DISCLOSURE

The present disclosure is related to a new temperature-controlled electro-spray ion source that allows for improved heating of samples, and methods of use of the new source, particularly in the field of heat-induced changes in biopolymer structure and aggregation.

BACKGROUND

Electrospray ionization mass spectrometry (ESI MS) has become an indispensable tool in the study of protein higher order structure and dynamics, as it allows macromolecular properties to be probed under a variety of conditions, including analysis of non-native conformations of transient species, such as protein folding intermediates. In recent years, ESI MS was also applied to study protein aggregation, although such studies are typically limited to the analysis of various species that are populated at the end-point of the aggregation process. The ability of ESI MS to provide information on biopolymer complexes in real time has been used to monitor ordered dissociation and assembly of protein oligomers; however, detailed characterization of the aggregation process has remained out of reach of conventional ESI MS.

The transient nature of protein aggregation is an inherent feature of the process that makes it very difficult to provide an accurate description of this process. Once the aggregation process is initiated, it proceeds very fast, making it extremely difficult to produce distinct in process snap-shots. Even though ESI MS provides an elegant way to obtain snap-shots of various dynamic processes, a feature that has been used to study phenomena ranging from protein interaction with their endogenous ligands to enzyme catalysis, straightforward application of ESI MS to on-line monitoring of aggregation processes is impractical due to the unfavorable time scale of the processes. Therefore, it is not surprising that most studies of protein aggregation focus on the endpoints of this process, i.e., early precursors to aggregation and the high molecular weight oligomers.

Another factor that greatly complicates the analysis of the aggregation process is the astonishing polymorphism exhibited by both the products and the intermediate states of the aggregation process. Earlier attempts to reduce the complexity of these ensembles by using a combination of separation techniques (e.g., size-exclusion chromatography, SEC) and ESI MS were only partially successful, since the intermediate oligomeric species collected as SEC fractions are very dynamic and frequently continue to evolve after (and perhaps even during) the separation process. As a result, a detailed mechanistic understanding of protein aggregation is still lacking, and the role of various non-native protein states in this process remains a subject of on-going debates.

Protein aggregation can be modulated in vitro by a variety of factors, and protein solution temperature is one of the parameters that have a profound effect on this process. The effect of heat on protein behavior is widely exploited in biotechnology, e.g., in accelerated stability studies, where products are stressed by exposing them to high temperatures. However, dramatic changes in physical and chemical properties that frequently occur during stress-testing of proteins are difficult to interpret, which makes meaningful analysis extremely difficult. The capability of ESI MS to explore both conformation and binding properties of biopolymers makes this technique an attractive tool for characterizing protein behavior under heat-stress conditions. Nonetheless, even though the idea to monitor protein behavior in solution as a function of temperature using ESI MS was articulated nearly two decades ago, very few examples of using ESI MS to study protein behavior as a function of temperature have been reported so far.

An improved apparatus and methods are needed to probe fast, dynamic processes such as protein aggregation.

BRIEF SUMMARY

In one aspect, a temperature-controlled electrospray ionization source comprises a metallic capillary for transport of a sample, the metallic capillary connected to a sample injector at a first end and connected to a spray emitter at a second end, wherein the metallic capillary has a capillary length for the transport of the sample from the first end to the second end of the metallic capillary, and wherein the inner diameter of the spray emitter is substantially the same at both ends of the spray emitter, a metallic heat shield in thermal contact with the spray emitter, wherein the metallic heat shield surrounds the spray emitter and extends along the spray emitter length from the first end to the second end of the spray emitter, and a heating element in thermal contact with the metallic capillary and the metallic heat shield, wherein the metallic capillary is configured to connect to a voltage source, and the sample injector is configured to be in communication with a pump to infuse the sample into the metallic capillary at a flow rate of 0.01 to 100 μL/min.

In another aspect, a method of studying heat-induced structural changes in a large molecule comprises pumping a sample comprising the large molecule into a temperature-controlled electrospray ionization source at a solution temperature T, ionizing the sample to produce sample ions, introducing the sample ions into an analyzer for separation of the sample ions by the mass to charge ratio, and detecting separated sample ions, wherein the temperature-controlled electrospray ionization source comprises:

a metallic capillary for transport of a sample, the metallic capillary connected to a sample injector at a first end and connected to a spray emitter at a second end, wherein the metallic capillary has a capillary length for the transport of the sample from the first end to the second end of the metallic capillary, and wherein the inner diameter of the spray emitter is substantially the same at both ends of the spray emitter, a metallic heat shield in thermal contact with the spray emitter, wherein the metallic heat shield surrounds the spray emitter and extends along the spray emitter length from the first end to the second end of the spray emitter, and a heating element in thermal contact with the metallic capillary and the metallic heat shield, wherein the metallic capillary is configured to connect to a voltage source, and the sample injector is configured to be in communication with a pump to infuse the sample into the metallic capillary at a flow rate of 0.01 to 100 μL/min.

BRIEF DESCRIPTION OF THE DRAWINGS

Referring now to the drawings wherein like elements are numbered alike in several FIGURES.

Figure 1:
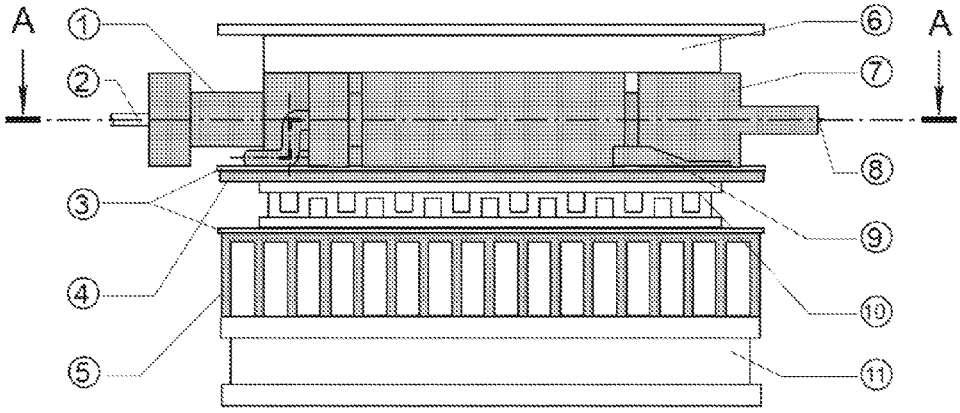
FIG. 1: Schematic of an embodiment of a temperature-controlled ESI source according to the present disclosure. In the schematic, 1—electrospray head, 2—sample injection tubing, 3—thermal interface pad (thermal conductor, electrical insulator), 4—copper plate, 5—heat sink, 6—electrical insulation, 7—heat shield, 8—spray emitter, 9—control thermistor, 10—thermoelectric cooler, 11—fan.

The above-described and other features will be appreciated and understood by those skilled in the art from the following detailed description, drawings, and appended claims.

DETAILED DESCRIPTION

Described herein is a novel ESI MS source that has improved temperature control and sample heating compared to prior heated static nanospray sources. Continuous-flow sample introduction eliminates the uncontrollable effects of heat that can result from static heating, and heat shielding of the spray emitter tip allows for controllable heat exposure without a significant temperature drop of the sample as it exits the spray emitter. The temperature-controlled ESI source and methods described herein are particularly useful to study structural changes in a large molecule such as a biomolecule, including structure unfolding, co-factor dissociation, aggregation, disulfide bond formation or cleavage, or a combination thereof.

Further described herein is an approach to following the progress of protein aggregation by exploiting the correlation between protein stability and temperature. As the temperature of a protein solution increases, the loss of conformational integrity manifests itself in ESI MS through a profound change in the ionic charge state distributions, while the formation of oligomers can be easily detected by monitoring the masses of various ionic species. Although protein aggregation is almost always implicitly assumed to be an irreversible process, reversibility of some steps (particularly in the beginning of the aggregation process) cannot be ruled out. In fact, the ability to shift equilibria during these early steps might become important in designing efficient therapies for a variety of pathological conditions where amyloidosis is implicated in disease etiology. Specifically, a new design of a temperature-controlled ESI source described herein allows both reversible and irreversible processes to be studied in heat-stressed biopolymers with high accuracy. The design features of the new source reduce artifacts that can interfere with the detection of temperature-induced changes of biopolymer properties. Validation of the techniques described herein was carried out by performing parallel characterization of several model systems with differential scanning calorimetry (DSC) and temperature-controlled ESI MS. In addition, the new source was also used to monitor heat-induced conformational change and aggregation of a 63 kDa glycoprotein human glucocerebrosidase (GCase), a 58 kDa glycoprotein antithrombin III (AT), a 92 kDa glycoprotein haptoglobin (Hp) and a 148 kDa glycoprotein monoclonal antibody (mAb), which are all biopharmaceuticals.

One common shortcoming of existing methods to monitor biopolymer behavior directly in solution in a temperature-controlled fashion is the rapid cooling of the analyte solution during its transfer to the ESI interface region. One prior design included a scheme for heating small sample volumes directly in the nano-ESI emitter prior to the sample introduction to the ESI interface. However, because the end of the ESI emitter is tapered from a large diameter to a small diameter, it is generally not feasible to insulate the tip. Thus, as the sample moves from the heated region to the tip, the sample experiences a noticeable temperature drop. This technique has been successful as a means to monitor irreversible processes in solution (e.g., dissociation and subunit exchange in large macromolecular assemblies). Temperature-induced unfolding of monomeric proteins had never been demonstrated with this design, unless applied to systems that undergo thermal unfolding irreversibly (e.g., proteins with significant number of disulfide bonds under acidic conditions).

Another problem is that in a prior art static nanospray ESI source, placing the protein solution in a small heated spray emitter for the entire duration of the experiment frequently causes uncontrolled protein degradation. This so-called "memory effect" may interfere with the measurement process and is likely to obfuscate evaluation of protein conformation and other characteristics of the protein as a function of temperature, resulting in effects of heat exposure rather than temperature.

One of the goals herein was to probe both reversible and irreversible changes in biopolymer higher order structure at elevated temperature. However, when a prior art static nanospray ESI source was applied to study heat-induced conformational changes in proteins that unfold reversibly (e.g., myoglobin), no signs of thermal denaturation were observed in ESI MS even at very high temperature. Myoglobin is a small protein that undergoes thermal denaturation at 70.8° C., which results in both loss of native conformation and dissociation of the prosthetic heme group. The former process manifests itself in ESI MS via dramatic changes in protein ion charge state distributions and the latter process can also be easily detected, as it results in a significant mass change. However, none of the expected changes were observed in ESI MS even when the spray emitter was heated to 90° C. Without being held to theory, it is believed that it is difficult to observe the reversible loss of higher order structure when using standard techniques because of rapid cooling of the protein solution upon exiting the heated part of the nano-ESI source. Passage of the analyte solution through the part of the nano-emitter not covered by the heating element should result in a significant heat transfer to the ambient environment due to the very large surface-to-volume ratio of the emitter tip. As a result, reversibly unfolded proteins have enough time to refold prior to the moment when the protein solution is introduced to the ESI interface and the ionic signal is produced.

The design of a temperature-controlled ESI source for studies of both reversible and irreversible processes in solution described herein was approached by modifying prior art designs with the aim of suppressing the heat loss and eliminating the memory effect. Rapid cooling of the protein solution in the ESI emitter is reduced/eliminated by using a metal heat shield covering the entire ESI emitter to the end of the emitter tip (FIGS. 1 and 2), and using large-diameter (e.g., 20 μm) capillaries as ESI emitters. The use of a large diameter through the end of the emitter tip allows for heat shielding through the end of the emitter tip, minimizing sample temperature reduction at the tip. This results in a dramatic decrease of heat exchange between the protein solution and the ambient environment prior to its introduction to the ESI interface due to lower surface-to-volume ratio of the tip of the emitter. Enclosing the entire ESI emitter inside a metallic heat shield provides thermal contact between the heating element and the spray emitter throughout its entire length, while the increased emitter tip diameter reduces the heat loss and dissipation from the tip due to increased surface-to-volume ratio. This arrangement greatly enhances the ability of the ESI source to maintain uniform temperature throughout the entire length of the spray emitter.

Further, the memory effect is reduced by switching from the static nano-ESI set-up to a continuous-flow scheme, where a protein solution is pumped through the heated capillary to the ESI interface. These new design features resulted in dramatic improvement of the ability to observe both reversible and irreversible heat-induced denaturation in small proteins.

Figure 21:
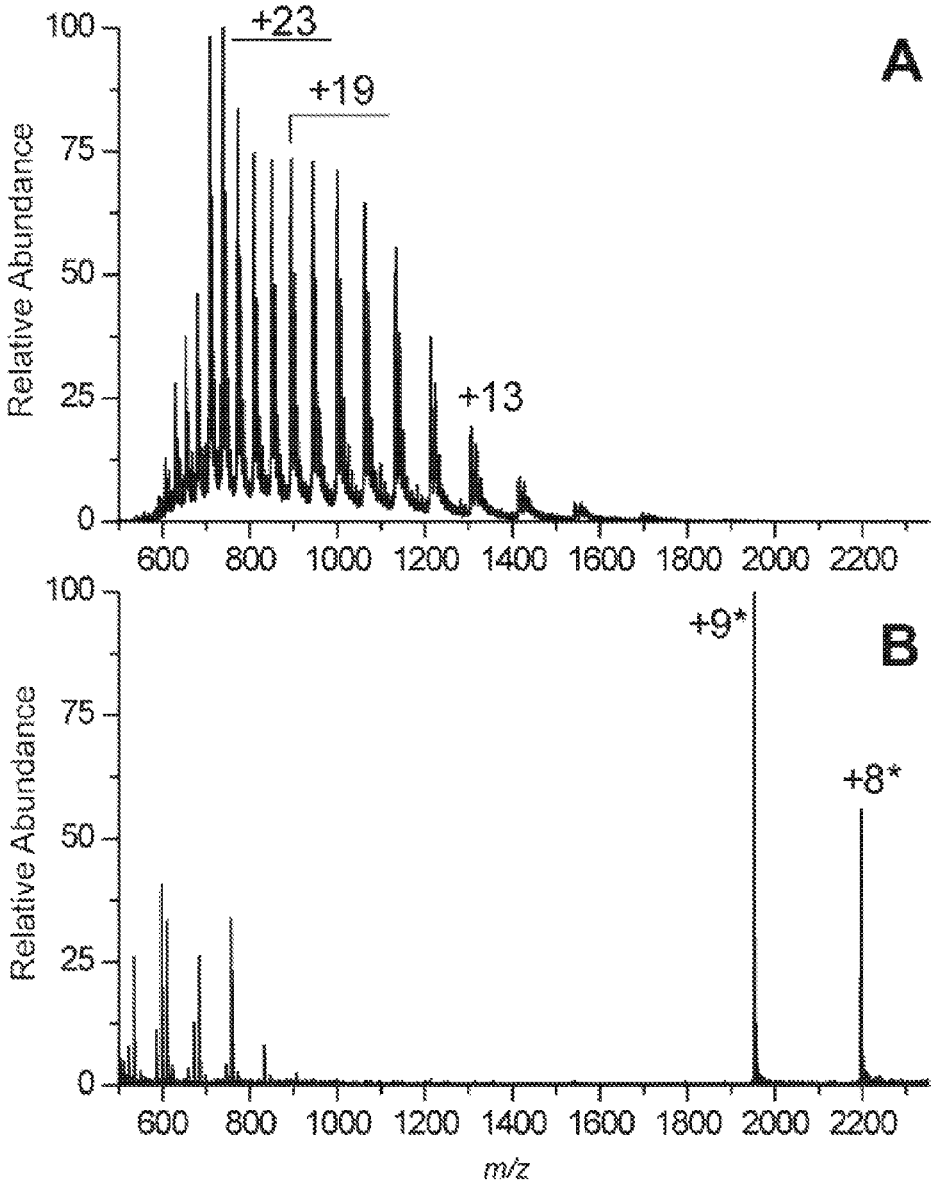
FIG. 21: Legend: ESI mass spectra of myoglobin acquired room temperature using the new temperature-controlled ESI source with (A) and without (B) grounding the syringe pump supplying the protein solution. Peaks labeled with asterisks correspond to holo-myoglobin, and peaks without asterisks correspond to apo-myoglobin ions.

Another problem that was addressed during the design of the temperature-controlled ESI source was the desire to eliminate electrochemical effects, leading over time to lowering the solution pH and, as a consequence, protein unfolding. Grounding the syringe supplying the protein solution to the ESI source (a standard procedure recommended by the instrument manufacturer to avoid build-up of static electricity) resulted in apparent acidification of solution, followed by protein unfolding even at room temperature, a phenomenon that was previously observed in VanBerkel et al. 1997 and Konermann et al. 2001. In order to minimize the solution pH changes leading to false-positive signals of protein unfolding, the protein loading syringe was ungrounded during all measurements. This resulted in substantially complete elimination of the solution acidification (as suggested by the measurement of the pH of the sprayed solution) and any false-positive signals of protein unfolding. (See, e.g., FIG. 21)

In one embodiment, an electrospray ionization source comprises a metallic capillary for transport of a sample, the metallic capillary connected to a sample injector at a first end and connected to a spray emitter at a second end, wherein the metallic capillary has a capillary length for the transport of the sample from the first end to the second end of the metallic capillary, and wherein the inner diameter of the spray emitter is substantially the same at both ends of the spray emitter, a metallic heat shield in thermal contact with the spray emitter, wherein the metallic heat shield surrounds the spray emitter and extends along the spray emitter length from the first end to the second end of the spray emitter, and a heating element in thermal contact with the metallic capillary and the metallic heat shield, wherein the metallic capillary is configured to connect to a voltage source, and the sample injector is configured to be in communication with a pump to infuse the sample into the metallic capillary at a flow rate of 0.01 to 100 μL/min.

In one embodiment, the sample injector is ungrounded. In this embodiment, the sample injector is allowed to float and attain a potential of a nearby conducting surface, e.g., the metallic capillary or an electrically conductive housing in which the sample to be injected is disposed. In another embodiment, the sample injector comprises a sample reservoir wherein the sample reservoir is not heated. In an embodiment, the sample injector is a tube that includes a material such as metal, ceramic, glass, plastic, or a combination thereof In a specific embodiment, the sample injector comprises polyether ether ketone (PEEK) tubing that is joined by, for example, a compression fitting such as union to the first end of the metallic capillary.

The length of the sample injector is flexible and in practice is dependent upon the minimal distance between, for example, the syringe pump and the spray source. In general, the length of the sample injector does not affect the performance of temperature regulation. Exemplary lengths of the sample injector include 10 mm to 1000 mm, specifically 30 mm to 800 mm, and more specifically 50 mm to 500 mm The diameter of the sample injector is 1 μm to 1500 μm, specifically 10 μm to 500 μm, and more specifically 100 μm to 200 μm.

As used herein, "diameter" refers to the inner diameter of an item. As used herein, "tubing" includes material having a fluid conduction pathway and can have a transverse cross-sectional shape that includes circular, square, and the like.

In one embodiment, the sample injector is a syringe and the pump is capable of driving the syringe at a substantially constant and controllable flow rate. In practice, the lower limit on the flow rate is limited by the lowest stable flow rate provided by the pump; and the upper limit is limited by the pressure the sample injector, e.g., syringe, may bear. The flow rate is 0.01 to 100 μL/min, specifically 0.1 to 10 μL/min, and more specifically 0.2 to 5 μL/min. One advantage of the electrospray ionization source described herein is that the sample injector, e.g., a syringe, is not heated, so only the sample within the capillary is heated. The sample in the syringe is not subjected to the memory effect. In addition, by keeping the flow rate substantially constant and varying the temperature, the behavior of the sample at different temperatures can be studied. Another advantage is that the use of a pump to effect a continuous flow allows one to vary the flow rate. Thus, heat-induced behavior can be studied as a function of the duration of heat exposure by varying the flow rate.

The voltage source sets an electric potential of a voltage to the metallic capillary and also can be used to establish an electric field between the spray emitter and, for example, a sampling cone located downstream from the spray emitter. The sampling cone serves as an initial aperture for injection of the ionized sample into the mass spectrometer. The voltage source can supply positive or negative voltage relative to ground potential. In an embodiment, although not limited thereto, the magnitude of voltage from voltage source can range from about 500 V to about 4,000 V, and specifically greater than 1000 V.

In addition to the transportation of the sample solution, another function of the metallic capillary is to transport heat from heating element to the sample solution. In one embodiment, the capillary for transport of the material to be ionized is a metallic capillary such as a stainless steel capillary. Alternative materials for the metallic capillary include copper and aluminum, and it is noted that it is preferred that the metallic parts are made of the same metal so that any potential damage due to the difference of thermal expansion at elevated temperatures can be avoided.

Figure 2:
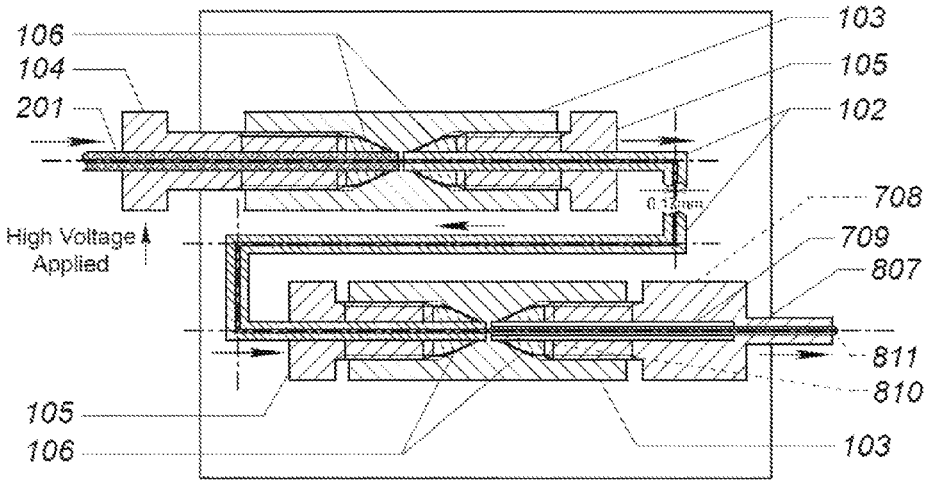
FIG. 2: Sectional view of the temperature-controlled ESI source of FIG. 1. The horizontal arrows indicate the flow of the sample through the source. The vertical arrow indicates the application of high voltage to ionize the sample. An injector 201 provides introduction of the sample into a metallic capillary 102. The metallic capillary 102 is disposed in a housing 103 and sealingly coupled to the injector 201 with lock nuts 104, 105 and ferrules 106. A spray emitter 807 is sealingly coupled in fluid communication to metallic capillary 102 with heat shield 708, sleeve 709 and ferrules 106. The spray emitter 807 includes a first end 810 and second end 811. The tip of the spray emitter 807 is disposed at the second end 811.

It is noted that the length of the metallic capillary and flow rate of the sample defines the time for heating of the sample. The metallic capillary can be formed into any shape as long as flow occurs at a rate effective to avoid the memory effect caused by appreciable residence times of the sample at a given temperature. In one embodiment, the metallic capillary for transport of the sample is in an S-shaped configuration as shown in FIG. 2.

In general, the lower limit on the length of the capillary is a length suitable to allow the sample's laminar flow profile to reach the temperature of the metal capillary; and the upper limit is the length that allows the sample to be heated for more than one hour at the typical flow rate. Exemplary lengths of the metallic capillary are 0.05 mm to 3000 mm, specifically 30 mm to 500 mm, and more specifically 60 mm to 120 mm. In general, the lower limit for the diameter of the capillary should not be smaller than the smallest inner diameter of the emitter. The diameter of the metallic capillary is 1 μm to 1500 μm, specifically 10 μm to 500 μm, and more specifically 100 μm to 200 μm. In a specific embodiment, the metallic capillary is a 90 mm, S-shaped stainless steel capillary.

The metallic heat shield surrounding the spray emitter is made of a material capable of transferring heat from the heating element to the sample. The heat shield can be made of a material with high thermal conductivity such as oxygen-free high conductivity copper and similar materials, for example aluminum or stainless steel.

The spray emitter is at the end of the capillary from which sample droplets emerge. The sample droplets are conveyed to a mass analyzer such as a triple-quadrupole, time-of-flight (TOF), quadrupole or linear ion trap, orbitrap, Fourier transform ion cyclotron resonance (FTICR) analyzer, or their combinations. Thus, in one embodiment, the electrospray ionization source is in operable communication with a mass analyzer.

The spray emitter is prepared from a material that can form a well-defined exit aperture for injecting the sample into the ESI interface. Exemplary materials include glass, polymers, metals, and the like. In one embodiment, the spray emitter is a polyimide-coated silica tube connected to the metallic capillary. In another embodiment, the spray emitter is optionally coated with a conductive coating such as metal, graphite, conductive polymer, etc.

In a specific embodiment, the metallic heat shield extends the length of the spray emitter. According to another embodiment, the metallic heat shield extends to within about 50 μm of the tip of the spray emitter, specifically within about 10 μm, and more specifically within about 1 μm. The spray emitter can be press fit into the metallic heat shield or disposed within the metallic capillary within the heat shield.

The length of the spray emitter ranges from the minimal length needed for proper connection to any length fitting the configuration of a certain instrument. In exemplary embodiments, the diameter of the spray emitter is 1 μm to 530 μm, specifically 5 μm to 50 μm, and more specifically 10 μm to 30 μm.

The heating element allows the control of the temperature of the capillary and thus the sample temperature. In one embodiment, the heating element is a thermoelectric cooler. An exemplary heating element comprises, in communication, a thermal interface pad with a thermal conductor and an electrical insulator, a copper plate, a heat sink and electrical insulation. The heating element allows for adjustment of the temperature of the capillary when the capillary is in thermal contact with the heating element. A thermal sensor, for example, a thermocouple, thermistor, and the like can be affixed to the electrospray ionization source herein. The temperature can be monitored using the thermal sensor, and the heating element can be configured to be connected to a controller interfaced with the thermal sensor for thermal control and feedback. Consequently, the temperature of the sample at the spray emitter can be controlled within about ±5° C., specifically about ±2° C., more specifically about ±1° C., and most specifically ±0.2° C. Thus, mass spectrometric data acquired from ions produced using the electrospray ionization source herein are reliable to within at least about 5° C., specifically about 2° C., and more specifically about 1° C.

The sample can include various liquids, including charged and neutral species, as well as collidal particles and nanoparticles, for example. In any case, the electric field produced at the tip of the spray emitter establishes a convenient way to form ions of an analyte in the sample. Further, the droplets of the sample issued from the spray emitter will have substantially the same temperature as the sample during transit through the metallic capillary.

The temperature-controlled electrospray ionization source described herein is particularly useful for studies of large molecules, e.g., molecules with molecular weights of 1 kDa to 5 MDa, including polymers and biomolecules, including molecular complexes. Exemplary systems for study include proteins and their complexes, nucleic acids, extensively glycosylated proteins, synthetic polymers and protein polymer conjugates, nanoparticles and their derivatives such as chemically treated nanoparticles with proteins or nucleic acids immobilized on their surfaces, and the like.

The term biomolecules includes nucleic acids and proteins. "Polynucleotide" or "nucleic acid" refers to a polymeric form of nucleotides at least 5 bases in length. The nucleotides can be ribonucleotides, deoxyribonucleotides, or modified forms of either nucleotide. Modifications include but are not limited to known substitutions of a naturally-occurring base, sugar or internucleoside (backbone) linkage with a modified base such as 5-methylcytosine, a modified sugar such as 2'-methoxy and 2'-fluoro sugars, and modified backbones such as phosphorothioate and methyl phosphonate. Nucleic acids are substantially complementary to each other when a sufficient number of corresponding positions in each molecule are occupied by nucleotides that can hybridize with each other in order to effect the desired process. As used herein, hybridization means hydrogen bonding, which may be Watson-Crick, Hoogsteen or reversed Hoogsteen hydrogen bonding, between complementary nucleosides or nucleotide bases.

A polypeptide contains two or more amino acid residues covalently linked by peptide bonds. The term protein generally refers to a polypeptide that is folded into a three-dimensional structure that provides a biological function. Proteins generally include the 20 naturally occurring amino acids, although the inclusion of modified amino acids is possible. In addition, proteins can be modified post-translationally.

The electrospray ionization source described herein is particularly useful for studying structural transformations in biomolecules, including reversible transformations. For example, the hybridization or dissociation of nucleic acid duplexes can be studied. Alternatively, the formation or melting of secondary and tertiary structure elements in RNA molecules can be studied. When the biomolecule is a protein, complete or partial loss of structure and complex formation can be studied, such as protein unfolding, protein aggregation, degradation or the formation/dissociation of structures containing two or more proteins.

Protein aggregation is a phenomenon which is frequently encountered in many fields of biology and biophysics. The negative connotation that is commonly attached to this phenomenon is mostly due to the critical role it plays in a variety of neurodegenerative disorders, but the occurrence of aggregation almost invariably leads to problems in many other areas as well. Despite the significant recent advances in deciphering the molecular mechanisms of biopolymer aggregation, numerous gaps in our understanding of this phenomenon still remain. One of the reasons for this is the extreme difficulty in tracking the aggregation processes using the existing experimental tools. Indeed, the populations of aggregating proteins are very complex, exhibiting high degree of structural heterogeneity (both in terms of oligomerization state of individual species and conformation of their constituents). Furthermore, the highly transient nature of such systems makes it nearly impossible to track their behavior in real time using existing experimental techniques.

Aggregation of recombinant proteins remains one of the most serious problems in biotechnology and particularly in the biopharmaceutical sector, where its occurrence in protein biopharmaceutical agents almost inevitably leads to immunogenic response, thereby adversely affecting their safety profile. Elimination or even control of aggregation in therapeutic proteins cannot be achieved without the knowledge of the molecular mechanisms of these processes. However, despite extensive efforts made in the past decade to study protein aggregation, many aspects of this process remain either poorly understood or completely unknown. Detailed study of the aggregation properties of polypeptide drugs is a very important aspect in the characterization of this expanding class of therapeutics, both from a stability and an efficacy standpoint, for example.

In one embodiment, a method of studying heat-induced structural changes in a large molecule comprises pumping a sample comprising the large molecule into an temperature-controlled ESI source at a solution temperature T, ionizing the sample to produce sample ions, introducing the sample ions into an analyzer for separation of the sample ions by the mass to charge ratio, and detecting separated sample ions, wherein the temperature-controlled electrospray ionization source comprises:

a metallic capillary for transport of the sample, the metallic capillary connected to a sample injector at a first end and connected to a spray emitter at a second end, wherein the metallic capillary has a capillary length for the transport of the sample from the first end to the second end of the metallic capillary, and wherein the inner diameter of the spray emitter is substantially the same at both ends of the spray emitter, a metallic heat shield in thermal contact with the spray emitter, wherein the metallic heat shield surrounds the spray emitter and extends along the spray emitter length from the first end to the second end of the spray emitter, and a heating element in thermal contact with the metallic capillary and the metallic heat shield, wherein the metallic capillary is configured to connect to a voltage source, and the sample injector is configured to be in communication with a pump to infuse the sample into the metallic capillary at a flow rate of 0.01 to 100 μL/min.

As used herein, structural changes include conformational changes (such as unfolding), aggregation (both reversible and irreversible), as well as alteration of covalent structure (such as disulfide bond formation or cleavage, etc.), for example.

In one embodiment, the large molecule is a biomolecule.

In one embodiment, the large molecule is studied at a plurality of temperatures, $T_i$, and the method optionally comprises determining an average charge state of the large molecule ions (for unfolding state determination), the proportion of species undergoing structural changes, and determining the mass of the oligomeric biomolecule ions (for aggregation state determination) at each temperature $T_i$. By calculating the average charge state of the large molecule ions at each temperature $T_i$, the folded/unfolded state of the large molecule can be determined. By calculating the fraction of signal representing ionic species undergoing structural changes at each temperature $T_i$, the proportion of this species can be determined. The aggregated/disaggregated state can be determined by the corresponding masses and intensities of the corresponding ionic peaks in the mass spectra. The transition temperature can be determined by plotting average charge state, the fraction of species undergoing structural changes, or aggregated/disaggregated states as a function of temperature.

In certain embodiment, the biomolecule is a protein or a nucleic acid molecule. Particularly interesting proteins are biopharmaceutical agents and disease-related proteins associated with aggregation, including amyloid proteins.

Advantageously, individual components of multicomponent systems can be studied simultaneously. That is, the temperature-controlled ESI source described herein can be used for multiplexed analysis. Thus, in one embodiment, the sample comprises two or more large molecules, and wherein structural changes in the two molecules are characterized simultaneously. For example, when the sample comprises two structured nucleic acid molecules such as two self-complementary DNA molecules, the melting temperature of each duplex can be measured in a single experiment (See. E.g., Example 6).

In one embodiment, large molecule aggregation and degradation are studies in the same experiment. Such an experiment is exemplified in Example 7.

In another embodiment, the ESI source and methods described herein are useful for assessing the stability and aggregation properties of biopharmaceuticals, for example under heat stress conditions. Conformational instability and aggregation of protein drugs can limit their shelf life and increase the likelihood of side effects (e.g., immunogenicity). The ability to characterize the temperature-dependent processes leading to protein drug degradation (unfolding and/or aggregation) is critical to the ability to develop new therapies to meet the increasing quality standards of the FDA and EMEA. (See, e.g., Example 3, 4, 5, 7, and 8)

The invention is further illustrated by the following non-limiting examples.

EXAMPLES

Materials and Methods

The design of the temperature-controlled ESI source (FIGS. 1 and 2) incorporated a long metal heat shield to eliminate cooling of the protein solution during the sample introduction to the ESI interface. Utilization of a large-diameter emitter (20 μm) and the heat shield, which covers the entire ESI emitter, results in a dramatic decrease of heat exchange between the protein solution and the ambient temperature prior to its introduction to the ESI interface. Enclosing of the entire ESI emitter inside a metallic heat shield provides thermal contact between the heating element and the emitter throughout its entire length, while the large diameter of the emitter tip reduces the heat loss and dissipation from the tip due to decreased surface-to-volume ratio. The heat shield also enhances heat propagation from the heating element through the bulk of the metal. Both phenomena greatly enhance the ability of the assembly to maintain uniform temperature throughout the entire length of the nano-ESI emitter. The memory effect was eliminated by switching from a classic static nano-ESI set-up to a continuous-flow scheme, where a protein solution is pumped through the heated capillary to the ESI interface. An S-shaped metal capillary within the heated volume was used to increase the efficiency of the heating process. Temperature control in the ESI source was carried out using thermoelectric cooler (TE Technology, Traverse City, Mich.). The syringe supplying protein solution to the ESI source was not grounded to eliminate electrochemical changes of solution pH. The new source was retrofitted to a QStar-XL (ABI/Sciex, Toronto, Canada) hybrid quadrupole/time-of-flight mass spectrometer.

All DSC measurements were performed with VP-DSC (MicroCal LLC, Northampton, Mass.) microcalorimeter. Each sample was prepared in a solution with the same recipe as what were used for its ESI MS measurement. DSC data were analyzed with the Origin software package (MicroCal LLC, Northampton, Mass.) for reference trace subtraction. Since all the numeric features on the thermograms other than $T_m$ are not of interest in this work, DSC thermograms are presented without concentration normalization and base-line construction/subtraction.

DNA single strands S1 (ACAGGTAATCAGTATGACGAA) (SEQ ID NO. 1), S2 (ATTCGTCATACTGATTACCTGT) (SEQ ID NO. 2), S3 (CCCAAATTTAAATTTGGG) (SEQ ID NO. 3) and S4 (CCCGGGCCCGGG) (SEQ ID NO.

4) were purchased from Eurofins MWG Operon (Huntsville, Ala.). Incongruent DNA strands S1 and S2 were used to eliminate the possibility of signal interference in ESI MS. The dsDNA sample was prepared by annealing the two complimentary strands using a standard procedure. Cytochrome c and Human haptoglobin (Hp) were purchased from Sigma-Aldrich Chemical Company (St. Louis, Mo.). Glucocerebrosidase (GCase) sample was provided by Shire HGT (Cambridge, Mass.). Recombinant human antithrombin III (AT) was provided by GTC Biotherapeutics, Inc. (Framingham, Mass.). A specific type of monoclonal antibody (mAb) was provided by Amgen, Inc. (Longmont, Colo.). All samples were prepared in ammonium acetate solution (pH adjusted to the indicated values with acetic acid or aqueous ammonia). All chemicals other than DNA or proteins were of analytical grade or higher.

Example 1

Precision of Detecting Reversible Changes in Biopolymer Higher Order Structure: Small Protein Unfolding Accuracy of the new source vis-à-vis detection of reversible conformational changes in biopolymers was evaluated by comparing the melting temperatures obtained using temperature-controlled ESI MS and differential scanning calorimetry (DSC). These transitions also result in significant changes in heat capacity, enabling their detection by DSC.

Figure 3:
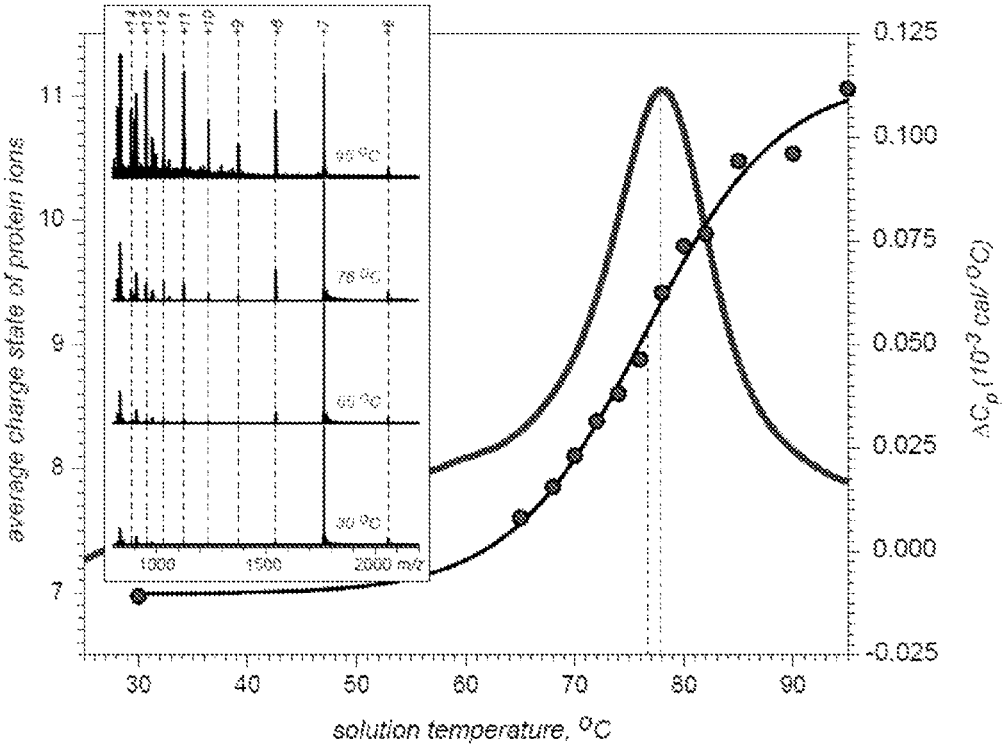
FIG. 3: Thermal unfolding of cytochrome c (in 20 mM ammonium acetate, pH 4.7) monitored with temperature-controlled ESI MS (curve with dots) and differential scanning calorimetry, DSC (solid curve). The two dashed lines show mid-points of transitions determined by the two techniques. ESI mass spectra of cytochrome c at several different temperatures are shown in the inset.

Cytochrome c is a small protein with a covalently attached heme group, which is known to undergo reversible thermal denaturation. A DSC profile of cytochrome c reveals a single transition at 78±1° C. (FIG. 3). Monitoring the charge state distribution of cytochrome c ions in ESI MS using the same solution parameters as in DSC experiments suggests that the protein remains folded until the solution temperature is raised above 65° C., at which time the emergence of the high charge-density protein ions provides a clear indication that a fraction of the protein molecules begin to populate non-native (less compact) states (inset in FIG. 3). Plotting the average charge of cytochrome c ions as a function of temperature in the 65-95° C. range results in a sigmoidal curve with a transition mid-point at 76±2° C. This value is within the experimental error of the melting point generated by DSC.

Example 2

Figure 4:
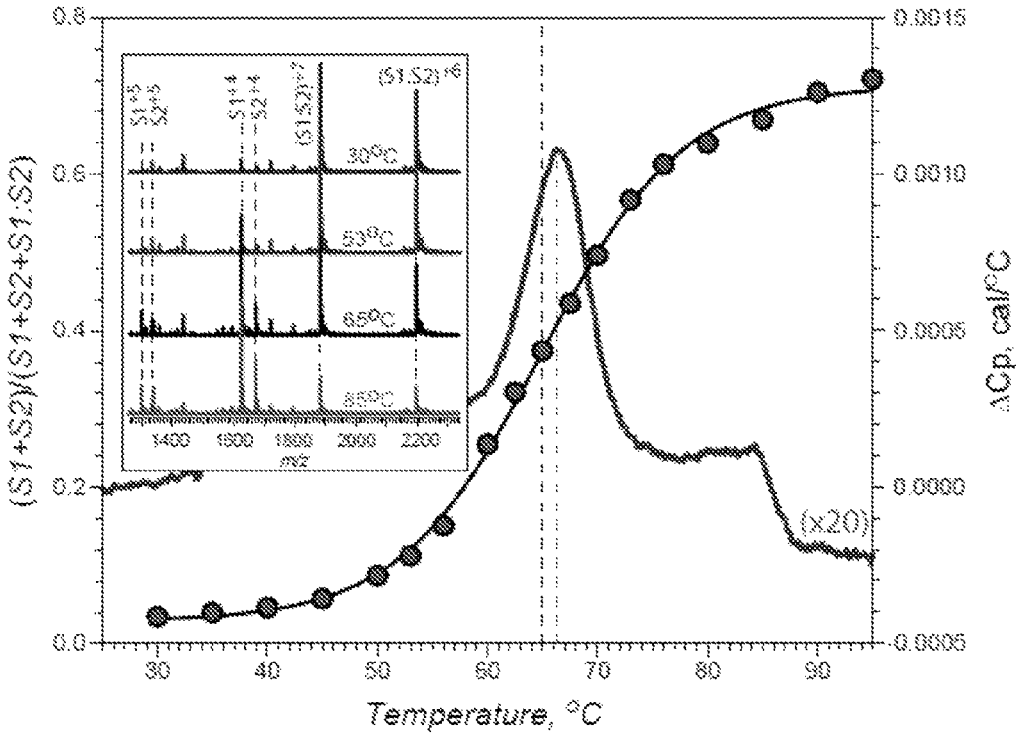
FIG. 4: Thermal dissociation of double-stranded DNA, dsDNA (in 150 mM ammonium acetate, pH 6.8) composed of complementary strands S1 and S2 monitored with temperature-controlled ESI MS (curve with dots) and DSC (solid curve). The two dashed lines show mid-points of transitions determined by the two techniques. ESI mass spectra of dsDNA at several different temperatures are shown in the inset.

Precision of Detecting Reversible Changes in Biopolymer Higher Order Structure: Dissociation of a DNA Duplex Monitoring ionic mass in ESI MS provides a very effective way to monitor the integrity of biopolymer assemblies. An example of a reversible heat-induced dissociation of a biopolymer assembly is presented in FIG. 4, where melting of a DNA duplex (made by annealing two complementary strands) is monitored over a 25-95° C. temperature range. Evolution of the fraction of singlet vs. total (singlet and duplex) DNA signal is used to calculate the transition mid-point as 64.9±2° C. DSC analysis of this DNA duplex carried out under the same conditions as ESI MS measurements (solvent composition and oligonucleotide concentration) yields melting temperature 66.4±1° C. (FIG. 4), which is within the experimental error of the value produced by ESI MS.

Example 3

Figure 5:
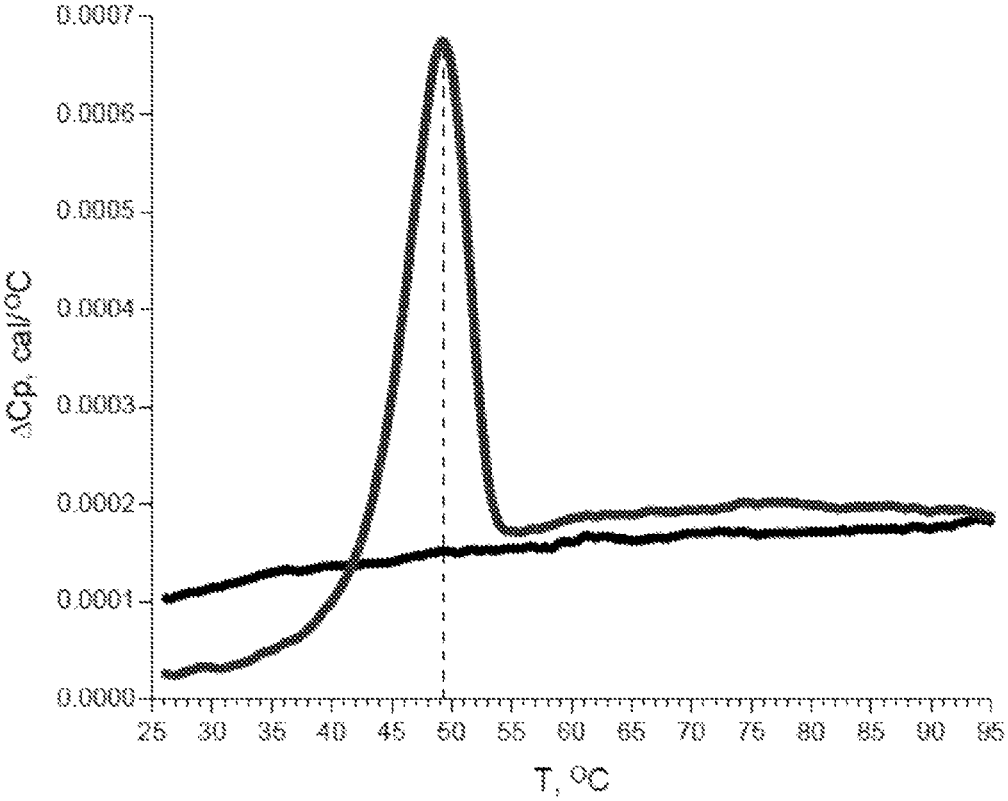
FIG. 5: DSC profile of glucocerebrosidase (in 20 mM ammonium acetate, pH 4.7) showing a transition at 49° C. (light trace). The black trace represents a re-run of the DSC experiment for the glucocerebrosidase sample that already went through a single cycle of DSC measurements.

Heat-Induced Protein Aggregation: Probing Convoluted Irreversible Processes with Temperature-Controlled ESI MS Following the validation of the new temperature-controlled ESI source with parallel DSC measurements, the new technique was applied to probe behavior of larger protein systems prone to aggregation. FIG. 5 shows a DSC profile of human glucocerebrosidase (GCase), a 63 kDa glycoprotein, which became a standard treatment of the Gaucher's disease. As is the case with all biopharmaceutical products, certain environmental factors may trigger GCase aggregation, a process that is of primary concern when stability, efficacy and safety of protein-based therapies are considered. Heat stress is frequently used to test protein instability; however, classical biophysical techniques that are commonly employed to detect the onset of GCase loss of stability in response to elevated temperature (such as fluorescence spectroscopy or DSC) do not provide a detailed description of this process at a molecular level. For example, the DSC profile of GCase (FIG. 5) clearly shows a well-defined transition at 49° C., in agreement with previously published work. The asymmetric shape of the peak suggests that the transition is irreversible, a hypothesis that is confirmed by the essentially flat appearance of the "second pass" DSC profile. However, very little can be said about the nature of the underlying processes based on the DSC data alone.

On the other hand, examination of the behavior of heat-stressed GCase with temperature-controlled ESI MS provides very rich information content. Indeed, not only does it allow the unfolding events to be detected, but also yields detailed information regarding specific molecular events that accompany such transitions (FIG. 5). While changes in the extent of multiple charging of protein ion are relatively minor in the 25-46° C. range, further increase of the protein solution temperature clearly leads to a large-scale loss of structure, as evidenced by the dramatic changes in the protein ion charge state distribution (i.e., appearance of the high charge-density protein ion peaks centered around charge state +27). This loss of structure at the level of GCase monomers coincides with the onset of GCase oligomerization. Although the extent of oligomerization observed at 50° C. is relatively modest, further temperature increase results in progressive growth of their sizes and abundance. Thus, temperature-controlled ESI MS provides a unique ability to monitor the emergence and evolution of soluble protein oligomers, which are likely to play important roles in aggregation.

Figure 6:
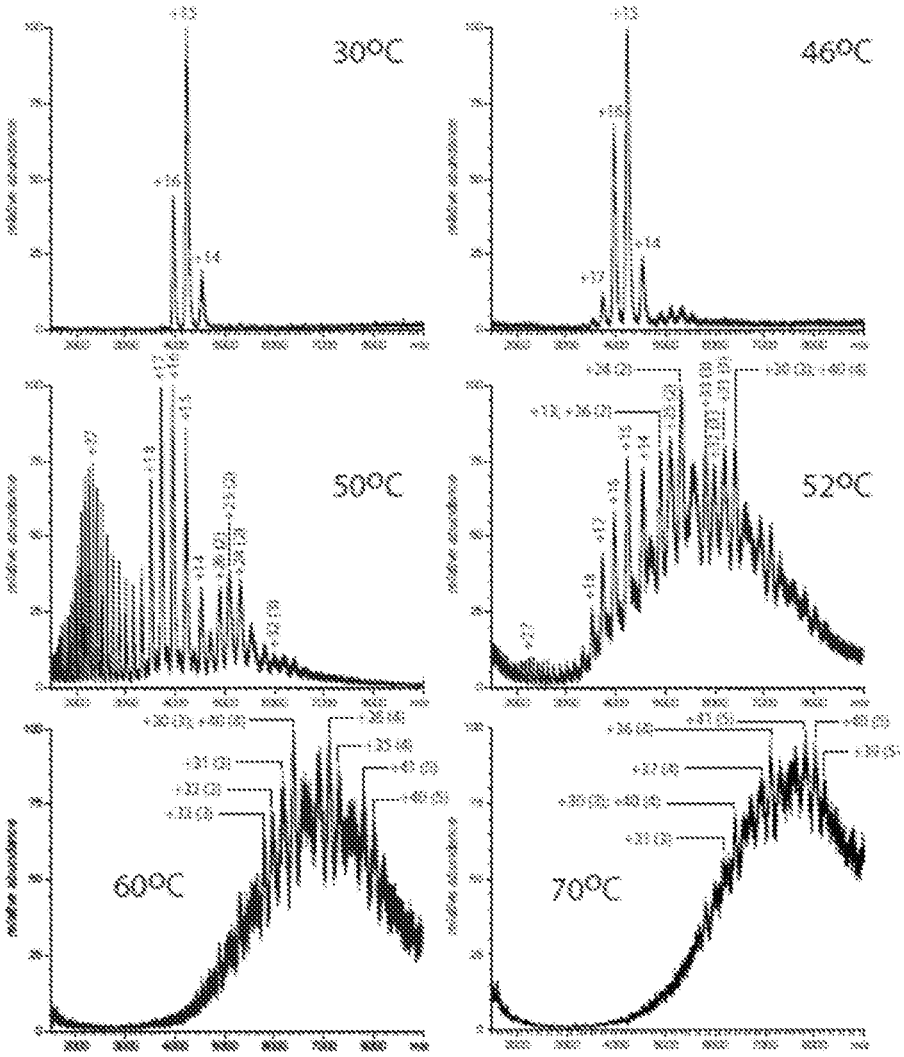
FIG. 6: ESI mass spectra of glucocerebrosidase (in 20 mM ammonium acetate, pH 4.7) recorded at various solution temperatures. Charge state assignments and oligomer size (in parentheses) are labeled for representative peaks.
Figure 7:
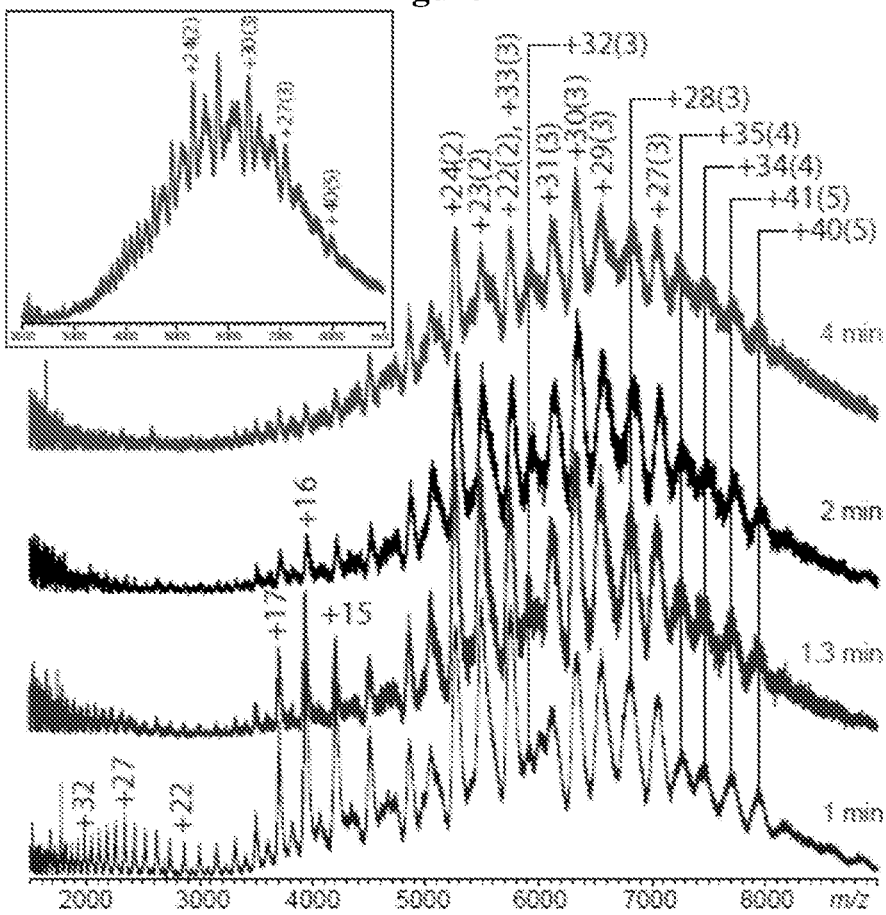
FIG. 7: Kinetics of heat-induced aggregation of glucocerebrosidase at 55° C. (in 20 mM ammonium acetate, pH 4.7); heat exposure time is varied by changing the protein solution flow rate in the ESI source. The inset displays an ESI mass spectrum of glucocerebrosidase incubated at 55° C. for one hour, followed by cooling the solution to room temperature (the mass spectrum was acquired at room temperature).

The protein solution flow rate was maintained at 1.0 μL/min for all measurements presented in FIG. 6, which corresponds to 2.0 minutes of heat exposure. The duration of the heat stress can be easily changed simply by varying the flow rate, and FIG. 6 shows the behavior of heat-stressed GCase at 55° C. as a function of the stress duration. One can clearly see that the unfolded monomers (represented in ESI MS by charge states higher than +18) are present in solution only following relatively brief heat exposure, while prolonged heating results in nearly complete elimination of such species, and an increase in the abundance of ionic species representing GCase oligomers. A reference mass spectrum for the end-point of heat stress at 55° C. was obtained by incubating GCase at this temperature for 1 hour, followed by cooling the protein solution to room temperature and acquisition of ESI MS data at room temperature. The resulting reference spectrum (inset in FIG. 7) is very close to the mass spectrum of GCase exposed to 55° C. for 4 minutes (e.g., complete absence of the protein monomer peaks and intensity distribution of oligomers peaks).

Analysis of the behavior of GCase as a function of both solution temperature and exposure time to heat clearly suggests that protein unfolding is the initial step leading to large-scale oligomerization of the heat-stressed GCase. The transient nature of this process is emphasized by the fact that the unfolded GCase monomers (represented in ESI MS by high charge density protein ions at m/z<3,000) are observed only in the narrow temperature range around 50° C. (FIG. 6). Appearance of unfolded GCase monomers coincides with the onset of protein oligomerization, and further temperature increase results in further shift of quasi-equilibrium towards larger oligomeric species. No unfolded monomers are seen in ESI MS at (and above) 55° C. under the quasi-equilibrium conditions, suggesting that they become converted to the oligomeric species on a faster time scale. Indeed, decreasing the heat exposure time at this higher temperature (FIG. 7) leads to re-appearance of high-charge density monomer ions in ESI MS, suggesting that unfolded GCase monomers are transiently populated even above the transition temperature. Taken together, these observations provide unequivocal evidence that unfolded GCase monomers are obligatory intermediates en route to aggregation.

The study of GCase behavior in response to a heat stress presented in this work demonstrates that the temperature-controlled ESI MS measurements allow the initial stages of protein aggregation to be characterized in great detail. Indeed, the ability to make a distinction between various biopolymer species (based on the differences in their masses) and their conformers (based on the differences in their charge state distributions) allows the temperature-controlled ESI MS measurements to be carried out in complex systems with a very high degree of specificity. This unique feature of the new experimental technique (coupled with the ESI MS ability to obtain mass information on very large biopolymers and their assemblies) makes it very appealing to the biotech and biopharmaceutical sectors, where the need to engineer/formulate stable biopolymer-based products (e.g., protein or nucleic acid drugs) places a premium on the ability to characterize their behavior as a function of temperature with a high degree of precision and accuracy. Likewise, the ability to observe and interpret changes in aggregation pathways caused by small molecules and therapeutic proteins will be invaluable for the on-going efforts to design effective medicines targeting amyloidosis-related disorders.

Understanding the molecular mechanisms of protein aggregation critically depends on availability of reliable and robust methods to monitor these processes. Heat stress remains one of the most popular approaches to evaluate the stability of aggregation-prone proteins in the biopharmaceutical industry, but the experimental techniques that are currently used in such studies do not provide detailed information on protein aggregation at the molecular level. The methodology based on temperature-controlled ESI MS allows early stages of heat-induced protein aggregation to be studied by monitoring both conformational changes and formation of oligomers as a function of temperature. Validation of the new methodology with model proteins and nucleic acids confirms its ability to obtain accurate information on reversible solution-phase processes. Furthermore, the new technique allows both reversible and irreversible processes involving biopolymers to be studied in a time-dependent fashion, where unfolding and formation of oligomers are correlated with both temperature and duration of heat exposure. These capabilities of the new methodology are highlighted by using it to study heat-induced aggregation of a biopharmaceutical product human glucocerebrosidase.

Example 4

Monitoring Small-Scale Conformational Changes of Antithrombin III

Figure 8:
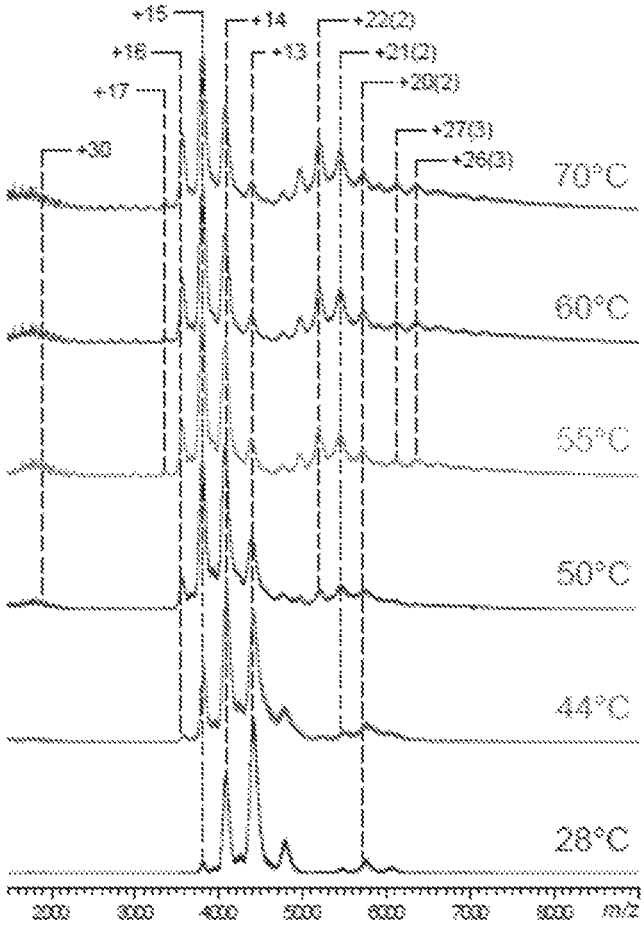
FIG. 8: ESI mass spectra of antithrombin III (in 20 mM ammonium acetate, pH 8.0) acquired at various temperatures. Charge state assignments and oligomer size (in parentheses) are labeled for representative peaks.
Figure 9:
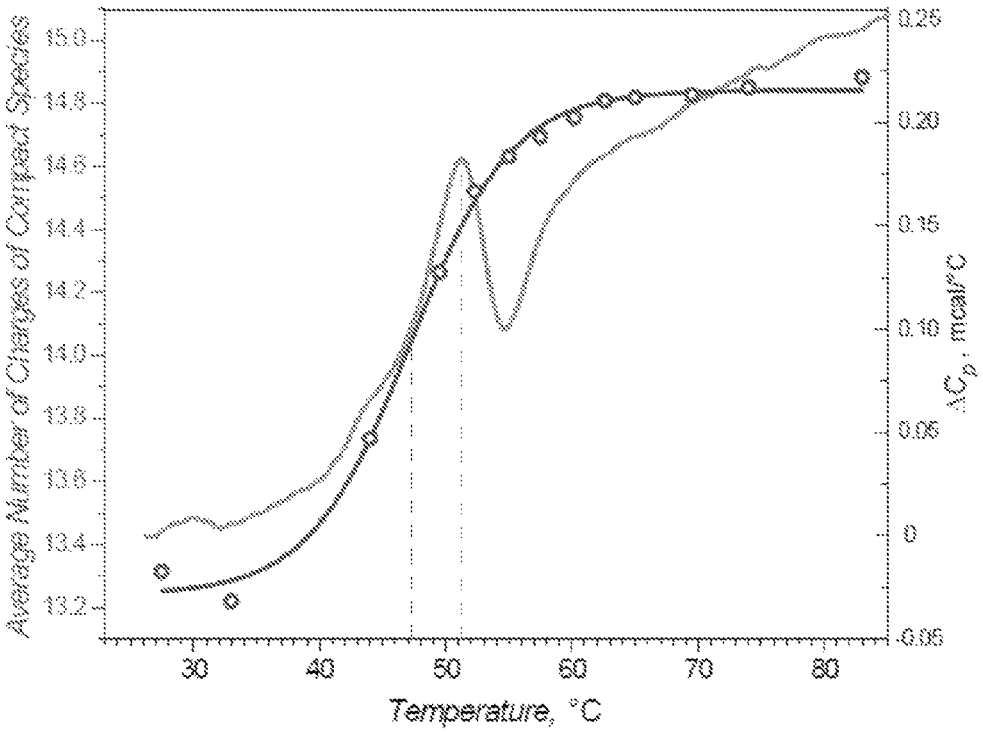
FIG. 9: Thermal transitions of antithrombin III (in 20 mM ammonium acetate, pH 8.0) monitored with temperature-controlled ESI MS (dotted curve) and DSC (gray curve). The two dashed lines show mid-points of transitions determined by the two techniques.

The investigation of heat-induced behavior of recombinant human antithrombin III (AT) under near-native conditions shows clear correlation between global unfolding of the protein and the onset of its aggregation. In addition to the large-scale loss of the structure of AT, a visible shift of the charge state distribution of ionic peaks representing compact proteins (here these peaks are defined as the less-charged bell-shaped part of the bimodal distribution) is also observed with the aggregation. The shift in the charge state distribution is due to small-scale conformational changes in AT during its aggregation, since in this case the effect of varied instrumental parameters (like emitter positions and the spray voltage) is eliminated by keeping the instrumental settings constant. The mass spectra of AT acquired at various temperatures are stacked in FIG. 8. With the elevation of temperature, although the global unfolding (as suggested by the high-charge-density peaks populated in the low-m/z region) is less pronounced than in the previously considered examples (e.g., heat-induced unfolding of GCase), protein aggregation takes place nonetheless, as evidenced by the gradual growth of both abundance and sizes of oligomeric AT. The charge state distribution of compact protein ions (i.e. +12-+17 charged ions) indeed shifts towards the higher-charge-density direction without any impact of the instrumental artifacts, representing the presence of a small-scale conformational change under heat-stress. Plotting the average charge state of compact AT ions as a function of temperature results in a sigmoidal curve with a transition point at 47±2° C., which is fairly closed to 51±1° C., the transition temperature yielded by the DSC measurement conducted under the same solution parameters (FIG. 9). The shifting range of the average charge states is higher than those induced by the change of any instrumental parameters in our regular experimental environment. This approximate agreement implies the correlation between the small-scale conformational change and the aggregation of AT.

Figure 10:
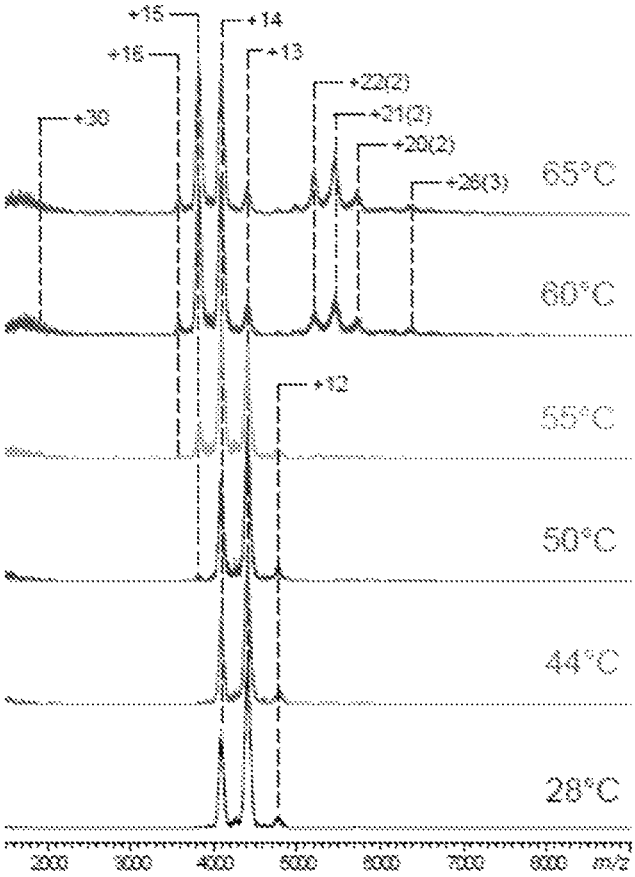
FIG. 10: ESI mass spectra of antithrombin III (in 150 mM ammonium acetate, pH 8.0) acquired at various temperatures. Charge state assignments and oligomer size (in parentheses) are labeled for representative peaks.
Figure 11:
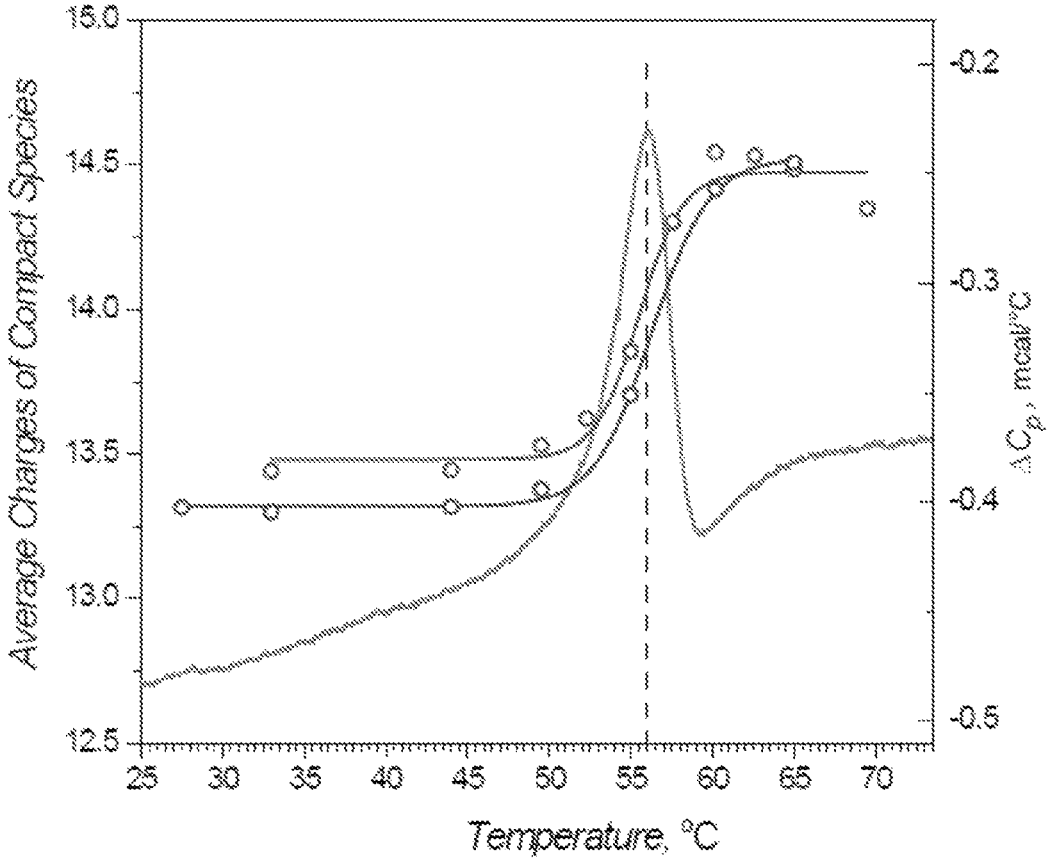
FIG. 11: Monitoring thermal transitions of antithrombin III (in 150 mM ammonium acetate, pH 8.0) by temperature-controlled ESI MS (upper dotted curve represents the first trial and lower dotted curve represents the second) and DSC (gray curve). The dashed line shows the mid-point of transition determined by DSC.

Since the transition temperature of a protein is dependent on the ionic strength of its solution, the salt concentration of an AT solution was increased from 20 mM to 150 mM, a condition of more physiological interest, in the parallel measurements with both temperature-controlled ESI MS and DSC to verify this correlation. The 150 mM solution clearly stabilizes the monomeric protein, as oligomerization does not occur until the temperature is raised to 55° C. in the ESI MS measurement (FIG. 10). Similarly, the charge states of ions representing compact proteins undergo a shift with the elevation of temperature. A similar sigmoidal-plotting was performed for the average charge states of these ions, and the resulting midpoint (55.5±2° C.) once again matches transition temperature measured by DSC (56.1±1° C.) within experimental error (FIG. 11). The result derived from another set of ESI MS measurements, which was repeated in the same fashion but with a different set of instrumental parameters optimized on another day, was overlaid on FIG. 11 as well. The transition patterns produced by two temperature-controlled ESI MS measurements exhibit good reproducibility (55.5±2° C. vs. 56.3±2° C.), and this agreement further demonstrates that the small-scale conformational change of AT reflected by the charge state increase of ions representing compact AT is specifically related to the aggregation process.

Example 5

Monitoring Sequential Conformational Transitions of a Monoclonal Antibody (mAb)

Based on the established correlation between the minor charge state shift of compact protein ions and small scale conformational change of a protein during its thermal denaturation, the methodology outlined in Example 4 was applied to a mAb for investigation of its more sophisticated behavior under heat-stress. In order to further exclude any potential interference induced by possible pH change including that caused by the protein denaturation, ESI MS and DSC measurements of the mAb were performed in the acetic acid—acetate buffer system.

Figure 12:
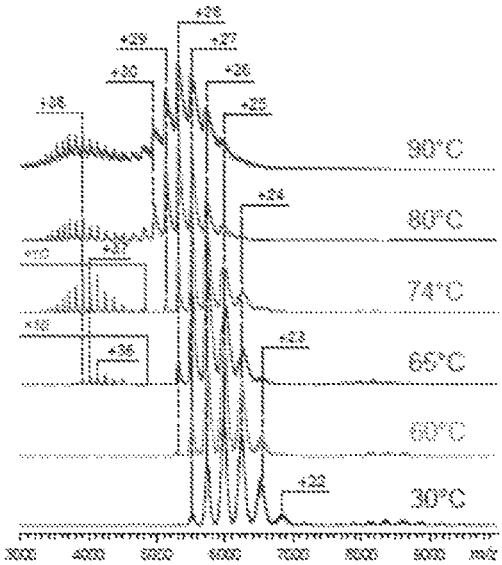
FIG. 12: ESI mass spectra of a monoclonal antibody (in 20 mM ammonium acetate, pH 4.7) acquired at various temperatures. Charge state assignments and oligomer size (in parentheses) are labeled for representative peaks.

Elevating the temperature of the mAb solution (in 20 mM ammonium acetate, pH 4.7) gave rise to a peak cluster corresponding to high-charge-density ions, suggesting the global unfolding under heat-stress (FIG. 12). Similarly to Example 4, the charge state distribution of the ions representing compact proteins shifts towards the high-charge-density direction as the temperature increases.

Figure 13:
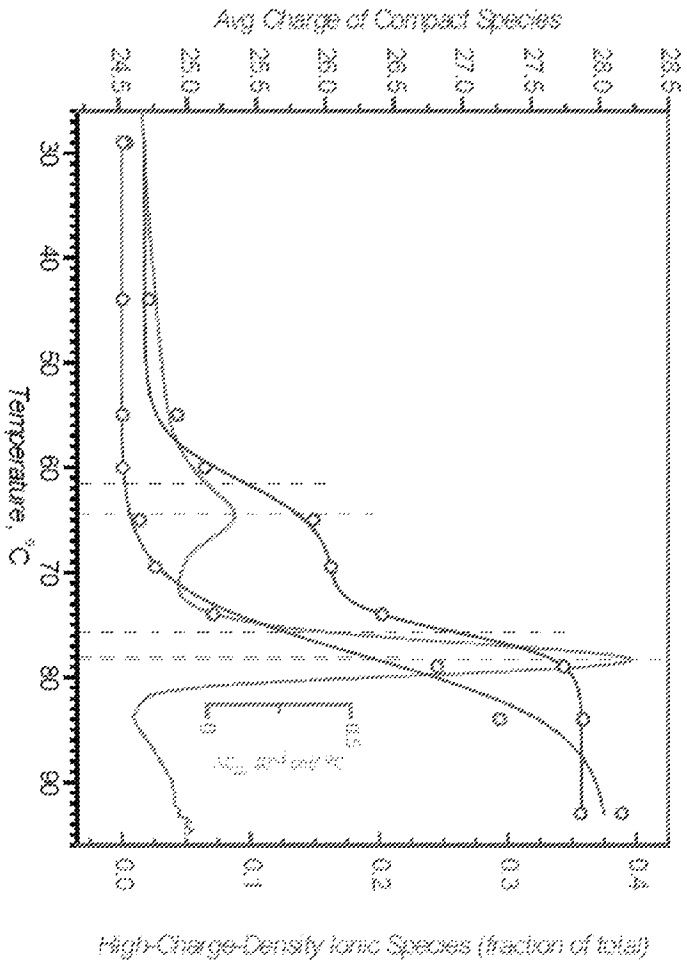
FIG. 13: Thermal transitions of monoclonal antibody (in 20 mM ammonium acetate, pH 4.7) monitored with temperature-controlled ESI MS (curve with dots) and DSC (light curve). The dashed lines show mid-points of transitions.

Some prior studies suggest that mAbs may unfold in a stepwise fashion before subsequent aggregation, leaving two or three distinct transition peaks in the DSC thermogram, e.g., Tischenko et al., 1982, Vermeer et al, 2000, Ionescu et al., 2008 and He et al., 2010. The number of transition peaks, as well as the area distribution of them, is dependent mostly on the variable domain sequence of the protein and secondarily on the parameters of the solution. The DSC measurement of the mAb solution used in this work yields a curve with two transitions centered at 64±1° C. and 78±1° C. respectively (FIG. 13, gray curve). The shape of this profile agrees with that of the same type of mAb reported by other investigators, although the measured $T_m$ are slight different due to the different salt conditions. The first transition has been attributed to the local unfolding of CH2 domain, and the second one to the Fab fragment and CH3 domain in prior studies.

For comparison between the conformational property measured by ESI MS and the thermodynamic property measured by DSC, average charges of the "compact" mAb ions are plotted as a function of temperature (FIG. 13, upper dotted curve). The resulting dot series, which clearly shows two transitions, is fitted using a double-sigmoidal curve. The mid-points of the two transitions 61±2° C. and 76±2° C. coincide within the experimental error with the two values of $T_m$ measured by DSC respectively. The average of the overall charge state of monomeric mAb ions (including the high-charge-density ions) is also plotted as a function of temperature and overlaid on FIG. 13 (lower dotted curve). This series of dots does not show a dramatic increase in the first transition region, and is therefore fitted with a single sigmoidal curve. The mid-point of this resulting curve, 78±2° C., agrees with the second $T_m$ yielded by either DSC thermogram or charge shifting profile of compact species.

This result demonstrates while the change of overall charge state distribution of monomeric protein is an accurate reflection of the global unfolding, the change of charge state of "compact" protein ions is able to sensitively probe the subtle conformational change during the sequential thermal denaturation, even though the extent of this change is on a smaller scale.

Example 6

Figure 14:
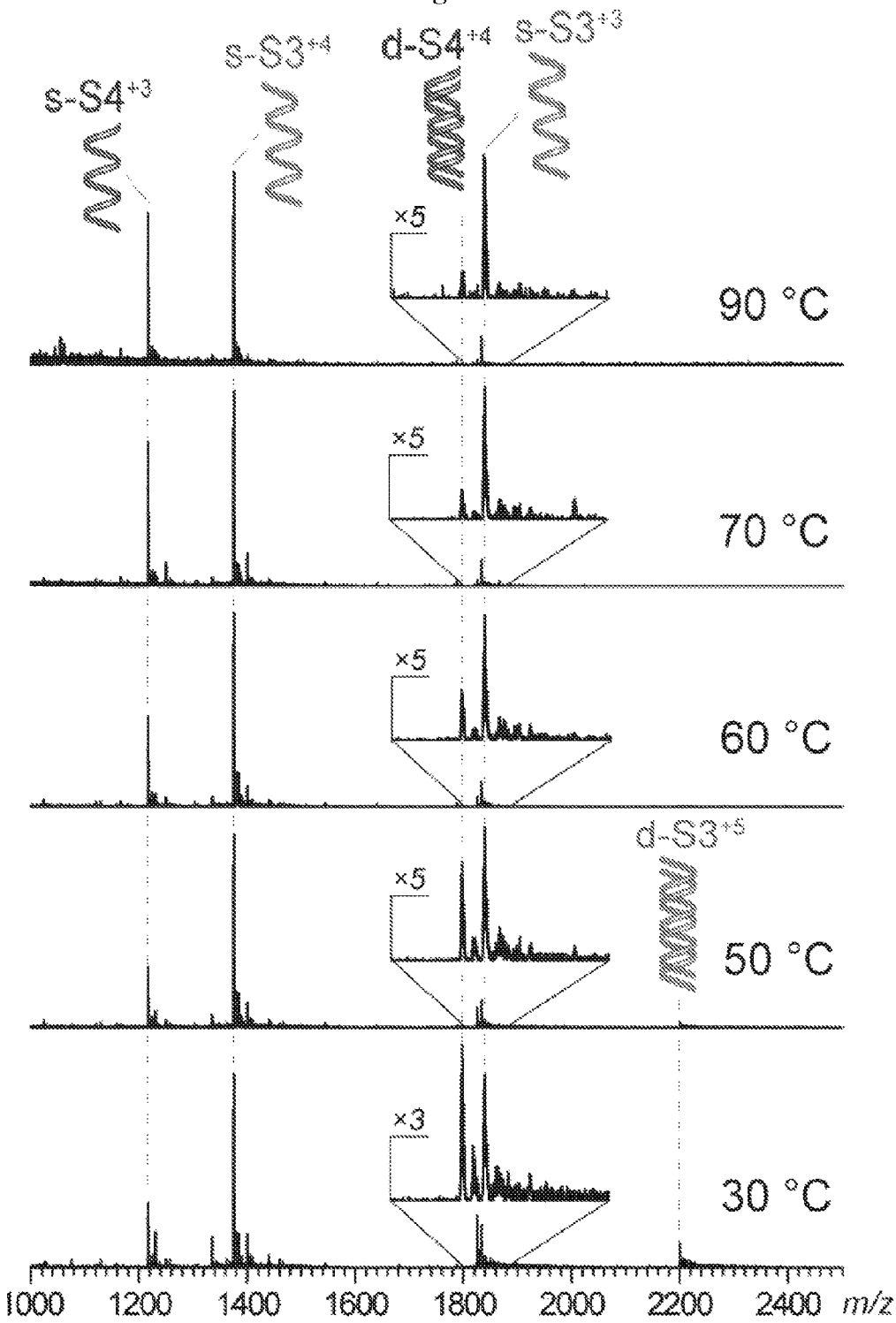
FIG. 14: ESI mass spectra of double-stranded DNA, dsDNA (in 200 mM ammonium acetate, pH 6.8) composed of two self-complementary strands S3 and S4 recorded at various solution temperatures. In the labels "s-" and "d-" denote "single-" and "double-" stranded species respectively.
Figure 15:
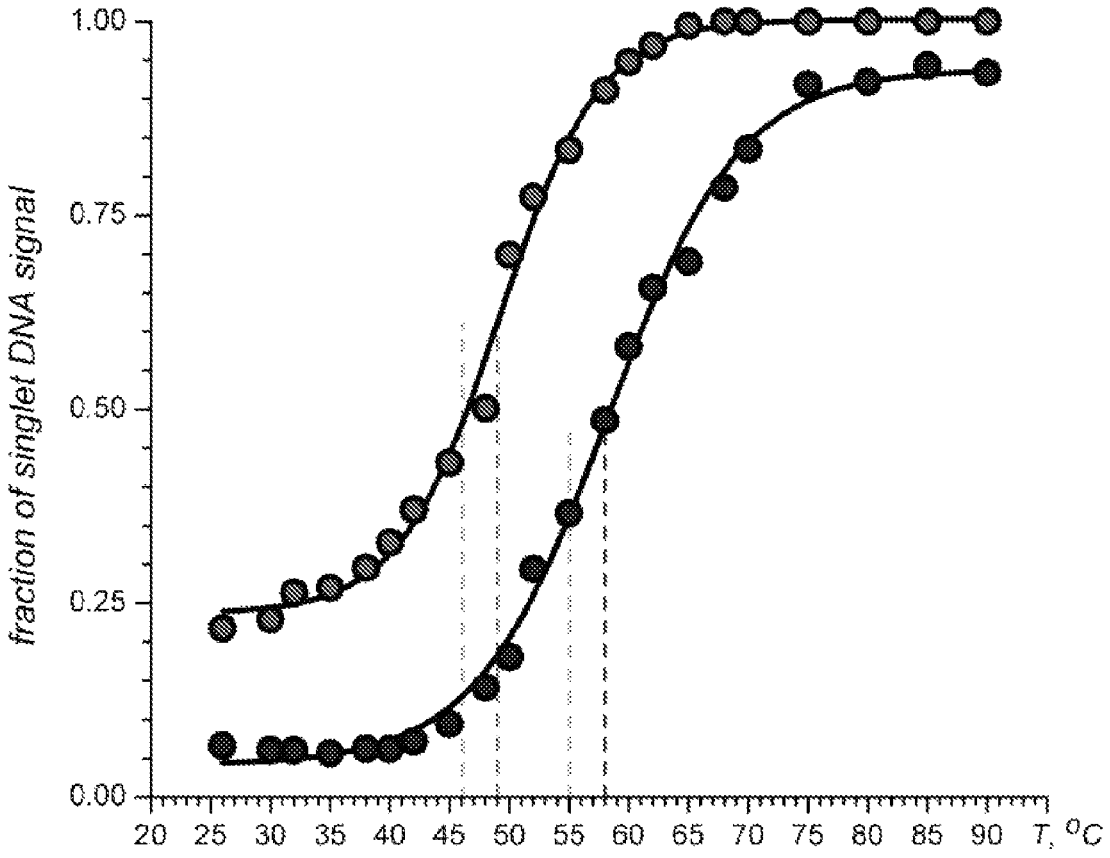
FIG. 15: Thermal dissociation of double-stranded DNA, dsDNA (in 200 mM ammonium acetate, pH 6.8) composed of self-complementary strands S3 (upper) and S4 (lower) monitored with temperature-controlled ESI MS. Mid-points of transitions determined by ESI MS are shown in colored dashed lines and the theoretical $T_m$ calculated based on salt-adjusted model are shown in gray dashed lines.

Profiling Thermal Dissociation of Different DNA Duplexes in a Multi-Component System Simultaneously—an Example Illustrating Multiplex Capability of the Temperature-Controlled ESI Source Melting of two double-stranded DNA (dsDNA) respectively composed of two self-complementary strands S3 (CCCAAATTTAAATTTGGG) (SEQ ID NO. 3) and S4 (CCCGGGCCCGGG) (SEQ ID NO. 4) in the same solution is monitored by temperature-controlled ESI MS, as presented in FIG. 14. Increasing solution temperature leads to increase of signal representing single-stranded species and decrease of signal corresponding to double-stranded species. Evolution of the fraction of singlet vs. total (singlet and duplex) DNA signal is used to calculate the transition mid-points as 49±2° C. for S3 and 58±2° C. for S4 (FIG. 15). These results are in good agreement with the two theoretical $T_m$ calculated based on salt-adjusted model, which are 46° C. and 55° C. This measurement demonstrates that temperature-controlled ESI MS is capable of characterizing respective behavior of multiple components under heat-stress without separation beforehand.

Example 7

Figure 16:
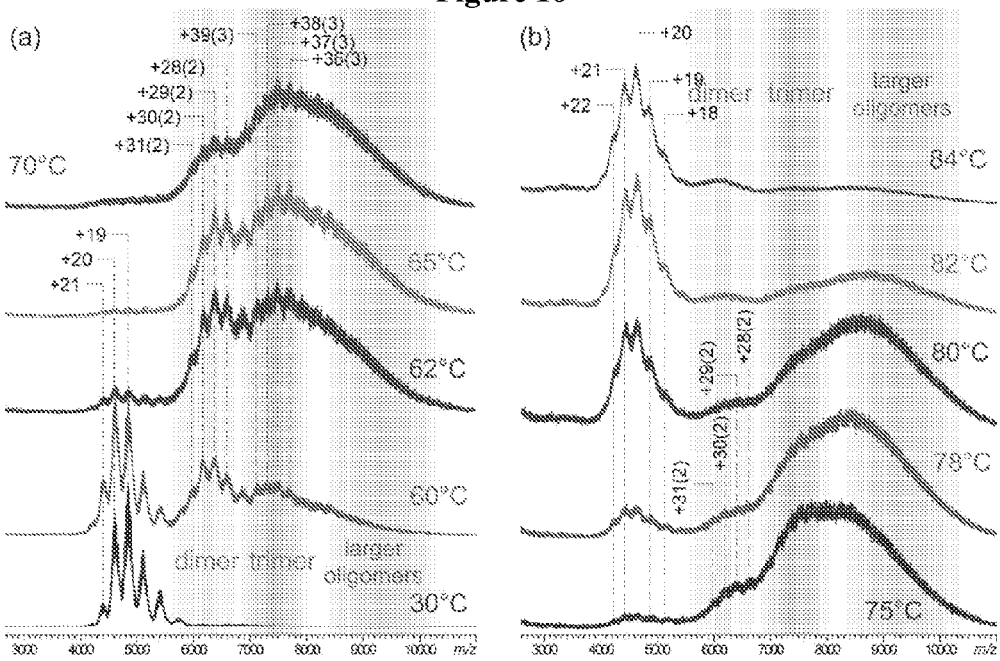
FIG. 16: ESI mass spectra of human haptoglobin (Hp; in 150 mM ammonium acetate, pH 6.8) recorded at various solution temperatures below 70° C. (panel a) and above 70° C. (panel b). Charge state assignments and oligomer size (in parentheses) are labeled for representative peaks.
Figure 17:
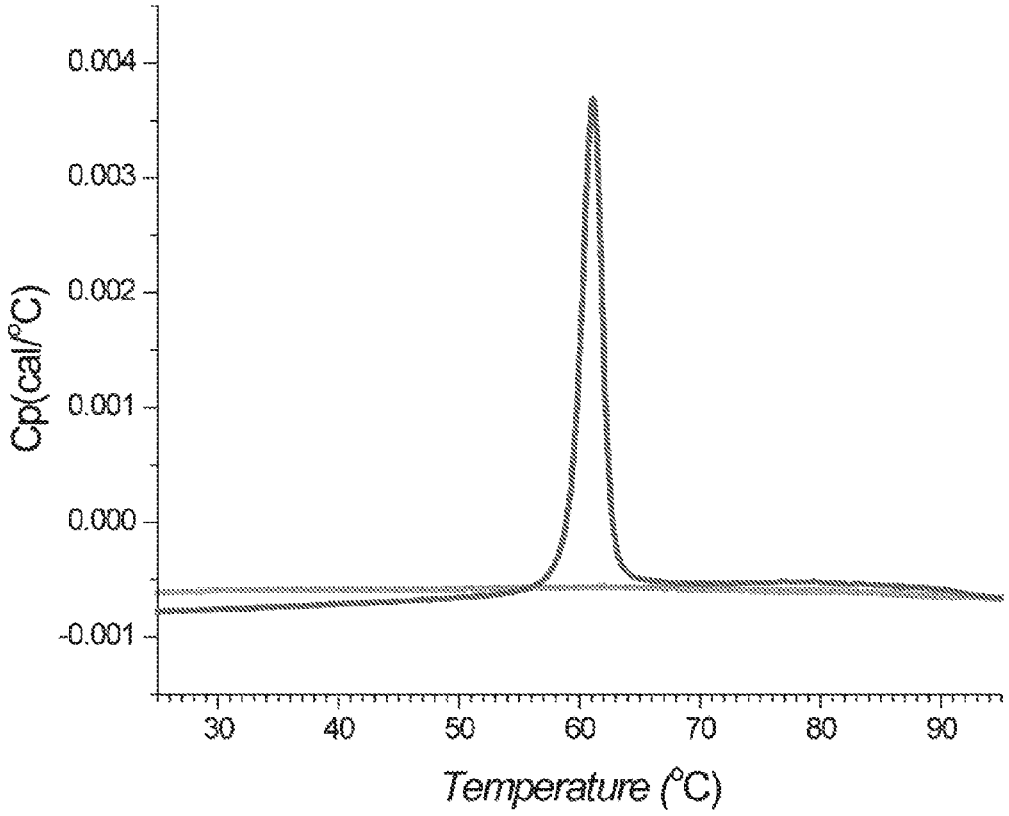
FIG. 17: DSC thermogram of Hp (in 150 mM ammonium acetate, pH 6.8) showing a transition at 61° C. (trace with sharp peak). The flat trace represents a re-run of the DSC experiment for the Hp sample that already went through a single cycle of DSC measurements.

Investigating Unusual Behavior of Human Haptoglobin (Hp) Under Heat-Stress—an Example of Monitoring Aggregation Followed by Thermal Dissociation of Multi-Protein Assemblies and Protein Degradation Applying temperature-controlled ESI to Hp, a 92 kDa glycoprotein consisting of two light chains and two heavy chains which are linked by inter-chain disulfide bonds, enables the observation of protein aggregation and some unusual behaviors including thermal dissociation of heat-induced protein oligomers and protein degradation. FIG. 16(*a*) shows a similar scenario of heat-induced behavior to those of other large glycoproteins such as GCase and AT: as the temperature is elevated from 30° C., Hp does not undergo noticeable oligomerization until the temperature reaches 60° C.; afterwards until 70° C. both size and relative abundance of oligomeric species increases with temperature, while the peaks corresponding to monomeric Hp recede gradually. The onset of oligomerization within experimental error agrees with 61±1° C., the $T_m$ of Hp measured by DSC (FIG. 17). However, as the protein solution gets further heated above 70° C., the abundance of oligomers decreases and that of monomer increases with the temperature, as shown in FIG. 16(*b*). Given that the absolute signal intensity of monomer peaks dramatically increases in these spectra, the predomination of monomeric species is not a result of further aggregation of Hp oligomers. This result suggests that the kinetic propensity of oligomerization of Hp decreases with temperature above 70° C.

Figure 18:
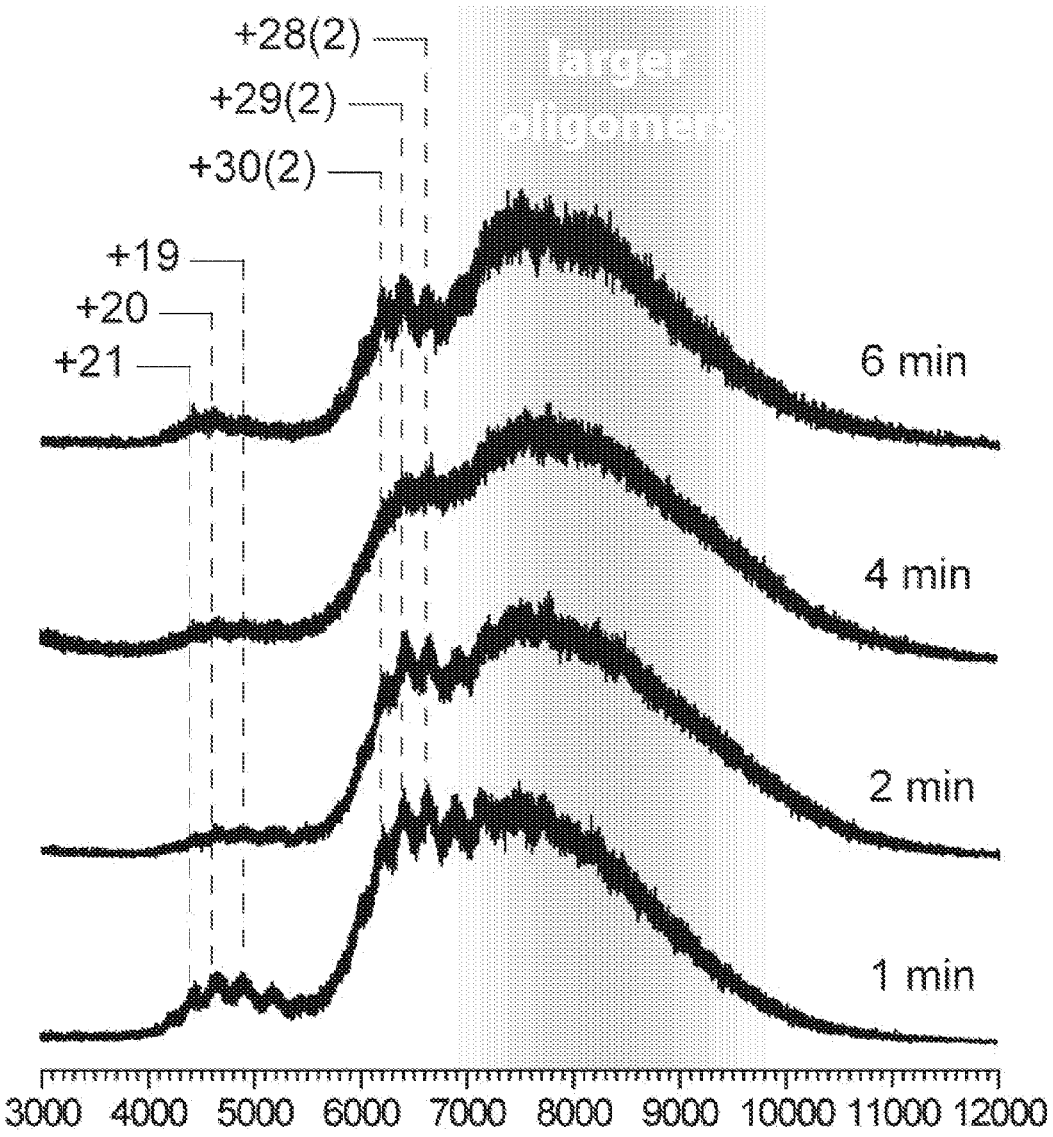
FIG. 18: Kinetics of heat-induced aggregation of Hp at 66° C. (in 150 mM ammonium acetate, pH 6.8); heat exposure time is varied by changing the protein solution flow rate in the ESI source.
Figure 19:
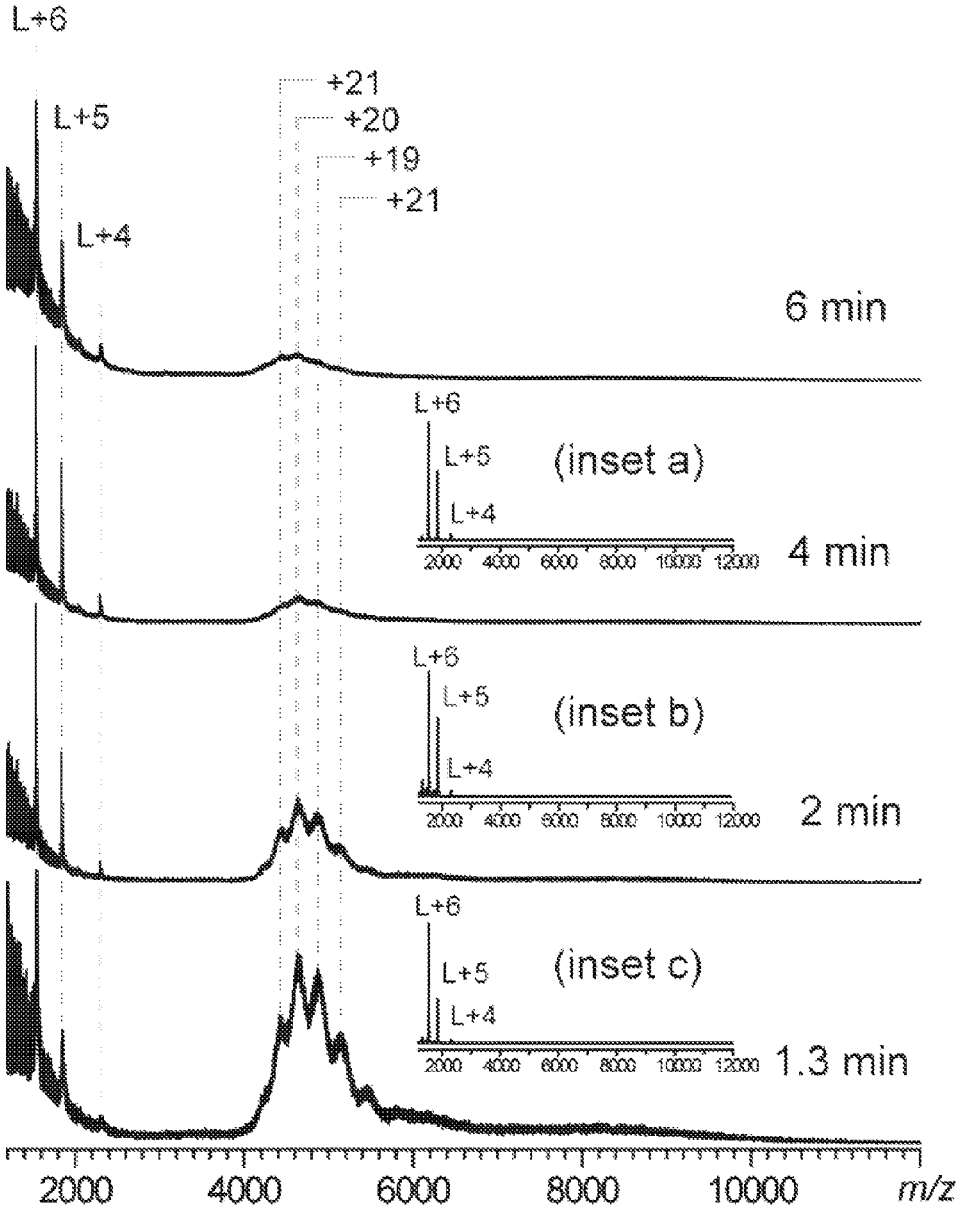
FIG. 19: Kinetics of heat-induced degradation of Hp at 84° C. (in 150 mM ammonium acetate, pH 6.8). Inset (a) displays an ESI mass spectrum of Hp incubated at 80° C. for 1 hour, followed by cooling the solution to room temperature; Inset (b) shows a spectrum of an Hp sample which went through 3 cycles of DSC measurements; Inset (c) is the mass spectrum of Hp incubated at 61° C. for 24 hours, followed by cooling the solution to room temperature. All the inset mass spectra were acquired at room temperature. "L" denotes light chain of Hp.

Prolonging the heat-exposure of Hp solution below and above 70° C. resulted in different responses of the Hp monomer. At 66° C., a longer stress duration promotes oligomerization to a higher extent, leading to reduced abundance of Hp monomer and increased abundance and size of oligomeric species (FIG. 18). At 84° C., however, longer heat-exposure increases the fraction of monomeric Hp which degrades, as evidenced by enhanced relative abundance of the peaks representing light chain of Hp (FIG. 19). The absence of heavy chain signals is attributed to the rapid aggregation of this species where the resulting large precipitates fell beyond the detectable m/z range. (data obtained by size-exclusion chromatography not shown) A reference mass spectrum for a long-term heat stress at comparable high temperature was obtained by incubating Hp at 80° C. for 1 hour, followed by cooling the protein solution to room temperature and acquisition of ESI mass spectrum at room temperature. The predominant peaks exhibited in the resulting reference spectrum are those representing light chains (inset (a) in FIG. 19). A similar pattern was obtained in the reference mass spectrum of the Hp sample which had gone through DSC measurements (inset (b) in FIG. 19). These reference spectra imply the end-point of heat-stress, i.e. the thermodynamic products of the stress above 70° C., are light chain and aggregated heavy chain of Hp.

In fact, as shown in inset (c) of FIG. 19, incubating Hp at 61° C. for 24 hours resulted in a mass spectrum with a similar pattern to inset (a) of FIG. 19, suggesting that the thermodynamic products of Hp under heat-stress are soluble light chain and heavy chain aggregates at any temperature above the denaturing temperature of Hp.

To summarize the behavior of Hp under heat-stress, monomeric Hp kinetically undergoes oligomerization and thermodynamically tends to degrade into sub-unit chains when $T_m<T<70°$ C. Above 70° C., degradation competes with oligomerization and gradually become the kinetically favored reaction as temperature increases.

Example 8

Figure 20:
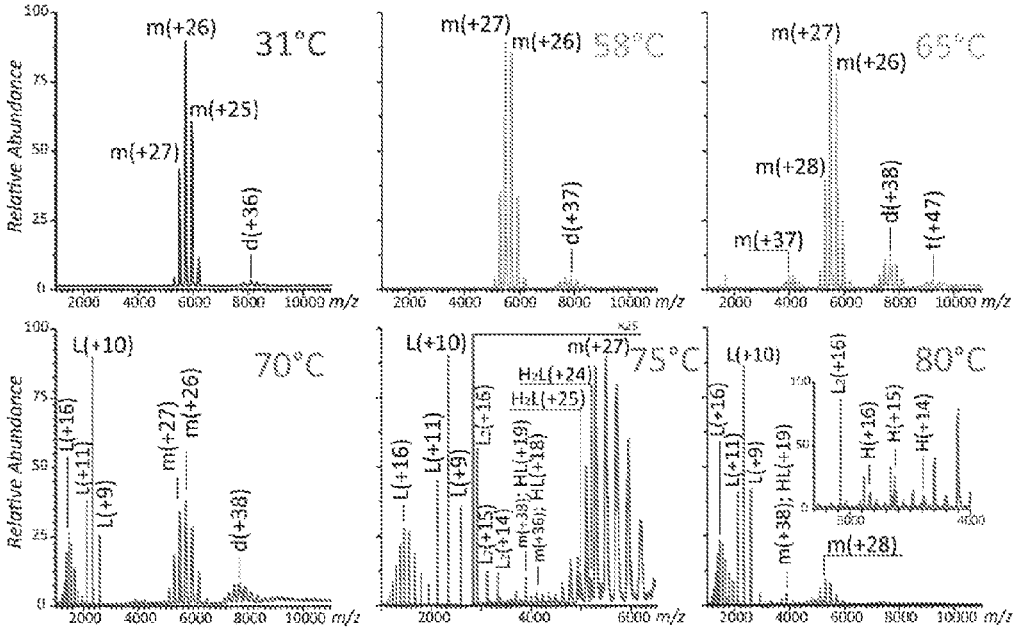
FIG. 20: ESI mass spectra of a monoclonal antibody (mAb) sample (in 20 mM ammonium acetate, pH 4.7) recorded at various solution temperatures. The sample has been stored in refrigerator at 4° C. for more than 1 year. In the labels: m, d, and t denote monomer, dimer, and trimer of intact mAb respectively; L and H denote light chain and heavy chain of mAb respectively. Numbers in parentheses indicate the charge state assignments. The inset in the 80° C. panel displays a close-up view within m/z 2700-4000 range of the spectrum.

Revealing Compromised Covalent Structure of a Monoclonal Antibody (mAb) During Prolonged Storage FIG. 20 shows ESI mass spectra of a mAb sample which had been stored at 4° C. for more than 1 year acquired in temperature-controlled fashion. While change in the charge distribution of low-charge-density-protein ion is observed only in the 31-58° C. range, a further increase of solution temperature to 65° C. clearly results in a fraction of mAb losing structure on a large-scale, as evidenced by the appearance of the high charge-density protein ion peaks centered around the charge state +37. Meanwhile, the extent of oligomerization is enhanced, as suggested by the growing size and abundance of oligomeric species. Further increase of the temperature above 70° C. leads to the appearance of a pronounced bimodal distribution of peaks representing both folded and unfolded mAb light chains (L), which were bound to heavy chains (H) via disulfide bonds in proteins. At higher temperatures, peaks corresponding to other mAb chains or inter-chain assemblies emerge, including H-H-L assembly ($H_2L$), H-L assembly (HL) and H which are part of natively intact mAb, and L-L assembly ($L_2$) which does not exist in native form of mAb and might be produced through disulfide scrambling. Such degradation of mAbs were not observed during the measurement of freshly manufactured mAb under the same conditions. These observations reveal that the covalent structure of the mAb had been compromised during the prolonged storage, while the protein maintained its "intact" geometry due to non-covalent forces. However, upon the thermal denaturation induced in the temperature-controlled measurements, the chains without disulfide linkages broke up and were released from the unfolded/partially unfolded mAb. Among these released species, light chains are the smallest and therefore feature highest signal response in ESI MS. Elevated solution temperature resulted in thermal denaturation of light chain as well as intact mAb, leading to a bimodal distribution of peaks representing light chains.

Advantageously, the temperature-controlled ESI source described herein overcomes at least two major disadvantages of prior art sources (i) rapid cooling of the protein solution during sample introduction into the ESI interface and (ii) memory effect. The memory effect refers to the degradation of a sample such as a biomolecule sample as a result of prolonged exposure of the sample to elevated temperatures. The former is minimized by using metal heat shields covering the entire ESI capillary, compared to the previously employed tapered sleeves. The memory effect is reduced by using a continuous flow scheme rather than a "static" nano-ESI. The continuous-flow scheme also allows for kinetic measurements of temperature-dependent protein unfolding and aggregation by changing the protein flow rate.

The use of the terms "a" and "an" and "the" and similar referents (especially in the context of the following claims) are to be construed to cover both the singular and the plural, unless otherwise indicated herein or clearly contradicted by context. The terms first, second etc. as used herein are not meant to denote any particular ordering, but simply for convenience to denote a plurality of, for example, layers. The terms "comprising", "having", "including", and "containing" are to be construed as open-ended terms (i.e., meaning "including, but not limited to") unless otherwise noted. Recitation of ranges of values are merely intended to serve as a shorthand method of referring individually to each separate value falling within the range, unless otherwise indicated herein, and each separate value is incorporated into the specification as if it were individually recited herein. The endpoints of all ranges are included within the range and independently combinable. All methods described herein can be performed in a suitable order unless otherwise indicated herein or otherwise clearly contradicted by context. The use of any and all examples, or exemplary language (e.g., "such as"), is intended merely to better illustrate the invention and does not pose a limitation on the scope of the invention unless otherwise claimed. No language in the specification should be construed as indicating any non-claimed element as essential to the practice of the invention as used herein.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from essential scope thereof Therefore, it is intended that the invention not be limited to the particular embodiment disclosed as the best mode contemplated for carrying out this invention, but that the invention will include all embodiments falling within the scope of the appended claims.

All cited patents, patent applications, and other references are incorporated herein by reference in their entirety.

SEQUENCE LISTING

```
<160> NUMBER OF SEQ ID NOS: 4

<210> SEQ ID NO 1
<211> LENGTH: 21
<212> TYPE: DNA
<213> ORGANISM: Artificial Sequence
<220> FEATURE:
<223> OTHER INFORMATION: Designed DNA single strand

<400> SEQUENCE: 1

acaggtaatc agtatgacga a                                              21


<210> SEQ ID NO 2
<211> LENGTH: 22
<212> TYPE: DNA
<213> ORGANISM: Artificial Sequence
<220> FEATURE:
<223> OTHER INFORMATION: Designed DNA single stand

<400> SEQUENCE: 2

attcgtcata ctgattacct gt                                             22


<210> SEQ ID NO 3
<211> LENGTH: 18
<212> TYPE: DNA
<213> ORGANISM: Artificial Sequence
<220> FEATURE:
<223> OTHER INFORMATION: Designed DNA single strand

<400> SEQUENCE: 3

cccaaattta aatttggg                                                  18


<210> SEQ ID NO 4
<211> LENGTH: 12
<212> TYPE: DNA
<213> ORGANISM: Artificial Sequence
<220> FEATURE:
<223> OTHER INFORMATION: Designed DNA single strand

<400> SEQUENCE: 4

cccgggcccg gg                                                        12
```

The invention claimed is:

1. A temperature-controlled electrospray ionization source, comprising a metallic capillary for transport of a sample, the metallic capillary connected to a sample injector at a first end and connected to a spray emitter at a second end, wherein the metallic capillary has a capillary length for the transport of the sample from the first end to the second end of the metallic capillary, and wherein the inner diameter of the spray emitter is substantially the same at both ends of the spray emitter, a metallic heat shield in thermal contact with the spray emitter, wherein the metallic heat shield surrounds the spray emitter and extends along the spray emitter length from the first end to the second end, of the spray emitter and a heating element in thermal contact with the metallic capillary and the metallic heat shield, wherein the metallic capillary is configured to connect to a voltage source, and the sample injector is configured to be in communication with a pump to infuse the sample into the metallic capillary at a flow rate of 0.01 to 100 μL/min.

2. The temperature-controlled electrospray ionization source of claim 1, wherein the sample injector is ungrounded.

3. The temperature-controlled electrospray ionization source of claim 1, wherein the sample injector comprises a sample reservoir, and wherein the sample reservoir is not heated.

4. The temperature-controlled electrospray ionization source of claim 1, wherein the sample injector comprises an injection tubing and a syringe, and wherein the pump drives the syringe at a constant and controllable flow rate.

5. The temperature-controlled electrospray ionization source of claim 1, wherein the length of the metallic capillary is 0.05 mm to 3000 mm and the diameter of the metallic capillary is 1 μm to 1500 μm.

6. The temperature-controlled electrospray ionization source of claim 5, wherein the metallic capillary has an S-shape.

7. The temperature-controlled electrospray ionization source of claim 1, wherein the heat shield extends the length of the spray emitter.

8. The temperature-controlled electrospray ionization source of claim 1, wherein the spray emitter has a diameter of 1 μm to 530 μm.

9. The temperature-controlled electrospray ionization source of claim 1, wherein the spray emitter has a length of 1 mm to 500 mm.

10. The temperature-controlled electrospray ionization source of claim 9, wherein the spray emitter is a polyimide-coated silica capillary.

11. The temperature-controlled electrospray ionization source of claim 1, wherein the heating element is a thermoelectric cooler.

12. A method of studying heat-induced structural changes in a large molecule, comprising pumping a sample comprising the large molecule into an electrospray ionization source at a solution temperature T, ionizing the sample to produce sample ions, introducing the sample ions into an analyzer for separation of the sample ions by the mass to charge ratio, and detecting separated sample ions, wherein the temperature-controlled electrospray ionization source comprises:

a metallic capillary for transport of a sample, the metallic capillary connected to a sample injector at a first end and connected to a spray emitter at a second end, wherein the metallic capillary has a capillary length for the transport of the sample from the first end to the second end of the metallic capillary, and wherein the inner diameter of the spray emitter is substantially the same at both ends of the spray emitter, a metallic heat shield in thermal contact with the spray emitter, wherein the metallic heat shield surrounds the spray emitter and extends along the spray emitter length from the first end to the second end of the spray emitter, and a heating element in thermal contact with the metallic capillary and the metallic heat shield, wherein the metallic capillary is configured to connect to a voltage source, and the sample injector is configured to be in communication with a pump to infuse the sample into the metallic capillary at a flow rate of 0.01 to 100 μL/min.

13. The method of claim 12, wherein the large molecule is studied at a plurality of temperatures $T_i$.

14. The method of claim 13, further comprising determining an average charge state of the large molecule ions, determining a proportion of species undergoing structural changes, and determining the mass of the oligomeric large molecule ions at each temperature $T_i$.

15. The method of claim 12, wherein the large molecule is a biomolecule.

16. The method of claim 15, wherein the biomolecule is a protein, a nucleic acid molecule, or an ordered complex comprising one or more of the foregoing biomolecules.

17. The method of claim 16, wherein the biomolecule is a protein suspected of undergoing aggregation.

18. The method of claim 15, wherein the biomolecule is a biopharmaceutical agent or a disease-related protein associated with aggregation.

19. The method of claim 18, wherein the disease-related protein associated with aggregation is an amyloid protein.

20. The method of claim 12, wherein the sample comprises two or more large molecules, and wherein structural changes in the two molecules are characterized simultaneously.

21. The method of claim 12, wherein large molecule aggregation and degradation are studied in the same experiment.

22. The method of claim 12, wherein the structural change in the large molecule is structure unfolding, co-factor dissociation, aggregation, or a combination thereof.

* * * * *